US010794118B2

(12) United States Patent
Azar et al.

(10) Patent No.: US 10,794,118 B2
(45) Date of Patent: Oct. 6, 2020

(54) FIXED CUTTER BITS AND OTHER DOWNHOLE TOOLS HAVING NON-PLANAR CUTTING ELEMENTS THEREON

(71) Applicant: SMITH INTERNATIONAL, INC., Houston, TX (US)

(72) Inventors: Michael G. Azar, The Woodlands, TX (US); Somasundaram Valliyappan, Spring, TX (US); Jason R. Gregg, Conroe, TX (US); Jordan Mark Self, Littleton, CO (US); Keisha Marie Spagnoletti, Denver, CO (US); Alexei Jozef Barr, Pearland, TX (US); Balasubramanian Durairajan, Sugar Land, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 113 days.

(21) Appl. No.: 15/777,226

(22) PCT Filed: Nov. 20, 2016

(86) PCT No.: PCT/US2016/062972
§ 371 (c)(1),
(2) Date: May 18, 2018

(87) PCT Pub. No.: WO2017/087920
PCT Pub. Date: May 26, 2017

(65) Prior Publication Data

US 2018/0334860 A1 Nov. 22, 2018

Related U.S. Application Data

(60) Provisional application No. 62/257,596, filed on Nov. 19, 2015.

(51) Int. Cl.
*E21B 10/567* (2006.01)
*E21B 10/42* (2006.01)

(52) U.S. Cl.
CPC ..... *E21B 10/5673* (2013.01); *E21B 10/42* (2013.01)

(58) Field of Classification Search
CPC ..... E21B 10/5673; E21B 10/562; E21B 10/42
See application file for complete search history.

(56) References Cited

U.S. PATENT DOCUMENTS 4,976,324 A * 12/1990 Tibbitts ..... E21B 10/5673 175/428
5,649,604 A * 7/1997 Fuller ..... E21B 10/43 175/431

(Continued)

FOREIGN PATENT DOCUMENTS

CN 2677582 Y 2/2005
CN 201024900 Y 2/2008

(Continued)

OTHER PUBLICATIONS

International Preliminary Report on Patentability issued in International Patent Application No. PCT/US2016/062972 dated May 31, 2018, 8 pages.

(Continued)

*Primary Examiner* — Michael R Wills, III

(57) ABSTRACT

A downhole cutting tool includes a body having a central axis extending therethrough, a plurality of blades extending outwardly from the body and converging towards a central region around the central axis, and at least one cutting element having a longitudinal axis, a non-cylindrical substrate, and an ultra-hard material body on the non-cylindrical substrate, the ultra-hard material body having a side surface extending around a cutting face and defining a cross-sec- (Continued)

tional shape of the ultra-hard material body, and the side surface comprising an edge having an inner angle of less than 180 degrees.

19 Claims, 16 Drawing Sheets

(56) References Cited

U.S. PATENT DOCUMENTS

| | | | | |
|---|---|---|---|---|
| 5,655,614 | A | 8/1997 | Azar | |
| 6,196,340 | B1 * | 3/2001 | Jensen | E21B 10/52 175/431 |
| 7,762,359 | B1 | 7/2010 | Miess | |
| 7,798,258 | B2 | 9/2010 | Singh et al. | |
| 2008/0053710 | A1 | 3/2008 | Moss | |
| 2010/0263939 | A1 * | 10/2010 | Hall | E21B 10/5673 175/430 |
| 2011/0266070 | A1 | 11/2011 | Scott et al. | |
| 2013/0112485 | A1 | 5/2013 | Richert et al. | |
| 2013/0199856 | A1 | 8/2013 | Bilen et al. | |
| 2015/0047912 | A1 * | 2/2015 | Pettiet | E21B 10/43 175/428 |
| 2015/0122553 | A1 | 5/2015 | Hall et al. | |
| 2015/0259988 | A1 | 9/2015 | Chen et al. | |
| 2015/0275584 | A1 * | 10/2015 | Mensa-Wilmot | E21B 10/43 175/431 |
| 2015/0285005 | A1 * | 10/2015 | Shamburger | E21B 10/55 175/57 |
| 2017/0058615 | A1 * | 3/2017 | Liang | E21B 10/5673 |
| 2017/0096859 | A1 * | 4/2017 | Spencer | B24D 3/008 |

FOREIGN PATENT DOCUMENTS

| | | | |
|---|---|---|---|
| CN | 203050523 | U | 7/2013 |
| CN | 104806172 | A | 7/2015 |
| CN | 204476290 | U | 7/2015 |
| CN | 201513124 | U | 10/2015 |

OTHER PUBLICATIONS

International Search Report and Written Opinion issued in International Patent Application No. PCT/US2016/062972 dated Mar. 7, 2017, 9 pages.

First Office Action and Search Report issued in Chinese patent application 201680069381.6 dated Aug. 8, 2019, 14 pages.

Second Office Action and Search Report issued in Chinese patent application 201680069381.6 dated Jul. 1, 2020, 10 pages.

* cited by examiner

FIXED CUTTER BITS AND OTHER DOWNHOLE TOOLS HAVING NON-PLANAR CUTTING ELEMENTS THEREON

BACKGROUND

Drill bits referred to as "fixed cutter" or "drag" bits, include bits that have cutting elements attached to the bit body, which may be a steel bit body or a matrix bit body formed from a matrix material such as tungsten carbide and a binder material. There are different types and methods of forming drag bits that are known in the art. For example, drag bits having cutting elements made of an ultra hard cutting surface layer or "table" (such as made of polycrystalline diamond material or polycrystalline boron nitride material) deposited onto or otherwise bonded to a substrate are known in the art as polycrystalline diamond compact ("PDC") bits.

PDC cutters have been used in industrial applications including rock drilling and metal machining for many years. In PDC bits, PDC cutters are received within cutter pockets, which are formed within blades extending from a bit body, and may be bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which may be a sintered metal-carbide to form a cutting structure. PCD includes a polycrystalline mass of diamond grains or crystals that are bonded together to form an integral, tough, high-strength mass or lattice. The resulting PCD structure produces enhanced properties of wear resistance and hardness, making PCD materials useful in aggressive wear and cutting applications where high levels of wear resistance and hardness are desired.

An example of a PDC bit having a plurality of cutters with ultra hard working surfaces is shown in FIG. 1. The drill bit 100 includes a bit body 110 having a threaded pin end 111 and a cutter end 115. The cutter end 115 includes a plurality of ribs or blades 120 arranged about the rotational axis L of the drill bit and extending radially outward from the bit body 110. Cutting elements, or cutters, 150 are embedded in the blades 120 at predetermined angular orientations and radial locations relative to a working surface and with a desired back rake angle against a formation to be drilled. The cutters may include a diamond or other ultra hard material layer disposed on a substrate, where the diamond layer contacts and cuts the formation and the substrate is attached to the blade.

A plurality of orifices 116 are positioned on the bit body 110 in the areas between the blades 120, which may be referred to as gaps or fluid courses. The orifices 116 are commonly adapted to accept nozzles. The orifices 116 allow drilling fluid to be discharged through the bit in selected directions and at selected rates of flow between the cutting blades 120 for lubricating and cooling the drill bit 100, the blades 120, and the cutters 150. The drilling fluid also cleans and removes the cuttings as the drill bit 100 rotates and penetrates the geological formation. The fluid courses are positioned to provide additional flow channels for drilling fluid and to provide a passage for formation cuttings to travel past the drill bit 10 toward the surface of a wellbore (not shown).

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole cutting tool that has a body having a central axis extending therethrough, a plurality of blades extending outwardly from the body and converging towards a central region around the central axis, and at least one cutting element, the at least one cutting element including a longitudinal axis, a non-cylindrical substrate, and an ultra-hard material body on the non-cylindrical substrate. The ultra-hard material body has a side surface extending around a cutting face and defining a cross-sectional shape of the ultra-hard material body, the side surface having an edge with an inner angle of less than 180 degrees.

In another aspect, embodiments disclosed herein relate to a cutting element that has a longitudinal axis, a substrate, and an ultra-hard material body disposed on the substrate, the ultra-hard material body having a non-planar outer surface with a plurality of linear peaks and a plurality of valleys alternating there between, the plurality of linear peaks converging at an apex.

In yet another aspect, embodiments disclosed herein relate to a downhole cutting tool that includes a body having a central axis extending therethrough, a plurality of blades extending outwardly from the body and converging towards a central region around the central axis, and at least one cutting element having a substrate and an ultra-hard material body on the substrate. The ultra-hard material layer may include a non-planar cutting face having two intersecting surfaces forming a linear peak, the linear peak extending a width of the non-planar cutting face, wherein an axial height of the ultra-hard material body along the linear peak varies.

Other aspects and advantages of the claimed subject matter will be apparent from the following description and the appended claims.

DETAILED DESCRIPTION

Figure 1:
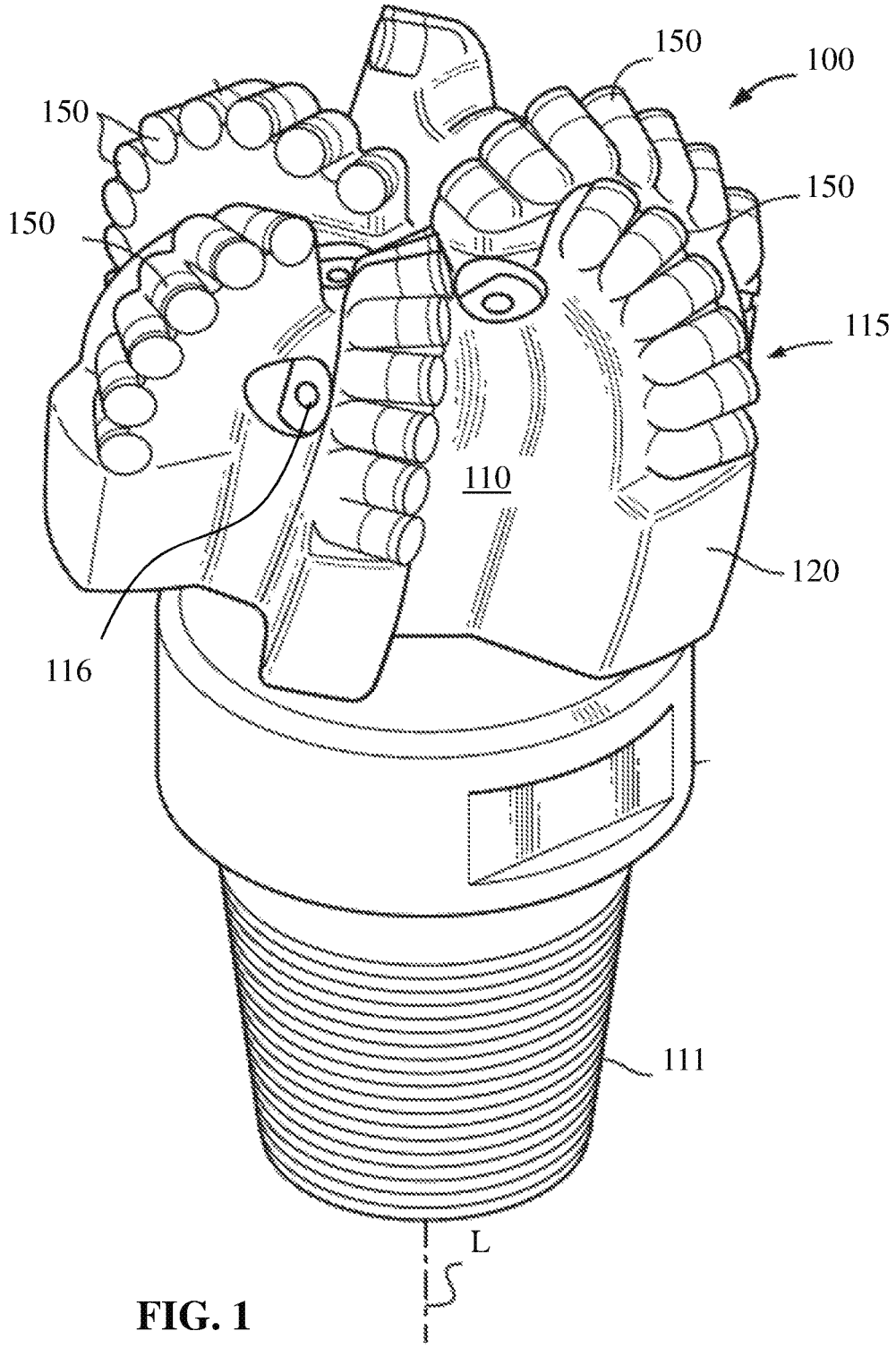
FIG. 1 (Prior Art)
FIG. 1 shows a perspective view of a conventional drill bit.

Embodiments disclosed herein relate generally to shaped cutting elements, such as cutting elements having a non-planar cutting face and/or cutting elements having a non-cylindrical base. Some embodiments disclosed herein relate to cutting elements having non-planar and non-conical cutting faces and such cutting elements on a cutting tool. Some embodiments disclosed herein relate generally to cutting elements having non-planar cutting faces on a non-cylindrical substrate and such cutting elements on a cutting tool. In some embodiments, cutting elements may be used on downhole drilling tools, for example, for plowing or wedge-type cutting actions or for coring. Further, some embodiments may be retained to a cutting tool using a floating retention mechanism.

According to some embodiments of the present disclosure, a cutting element may include an ultra-hard material body on a non-cylindrical substrate. As referred to herein, a non-cylindrical substrate may include a substrate having at least one non-circular cross-sectional shape along a plane transverse to its longitudinal axis. For example, a non-cylindrical substrate may have a polygonal prism shape, a hybrid cylinder and prism shape, or an elliptical cross-sectional shape. However, in some embodiments, a cutting element may have an ultra-hard material body attached to a generally cylindrical substrate, where a generally cylindrical substrate refers to substrates having circular cross-sectional shapes along the planes transverse to its longitudinal axis. For example, a cylindrical substrate may include a substrate with a circular cross-section having substantially equal diameters at each plane transverse to its longitudinal axis. In some embodiments, a generally cylindrical substrate may include a substrate with relatively small variations in its diameter, for example, in order to form a retention groove or a bevel or taper. Further, as used throughout this application, the terms "shape" and "size" will be separately referred to. For example, the cross-sectional shape of a cutting element may remain the same along each plane transverse to its longitudinal axis, while the size of the cross-sectional shape may vary along the planes transverse to the longitudinal axis.

Cutting elements having a non-cylindrical substrate may have an ultra-hard material body with a cross-sectional shape along a plane transverse to the cutting element longitudinal axis that aligns with a cross-sectional shape of the non-cylindrical substrate or that is a different shape than the cross-sectional shape of the non-cylindrical substrate. Further, some cutting elements having a non-cylindrical substrate may have an ultra-hard material body with a cross-sectional shape along a plane transverse to the cutting element longitudinal axis that aligns with a cross-sectional shape of the non-cylindrical substrate and that is a different shape from a cross-sectional shape of the non-cylindrical substrate, for example, if the non-cylindrical substrate has a combination of shapes or if the ultra-hard material body has a combination of shapes. For example, in some embodiments, a non-cylindrical substrate may have a combination of shapes, where the cross-sectional shape of the non-cylindrical substrate varies along its longitudinal axis, and in some embodiments, the cross-sectional shape of an ultra-hard material body may vary along the longitudinal axis.

An ultra-hard material body may be formed, for example, from diamond, boron nitride, or other ultra-hard materials and combinations thereof, and a substrate may be formed of, for example, cermets such as metal carbides, metal nitrides, metal borides or combinations thereof. For example, according to some embodiments, an ultra-hard material body may be formed of diamond and a substrate may be formed of tungsten carbide.

According to embodiments of the present disclosure, a cutting element may have an ultra-hard material body disposed on a non-cylindrical substrate and a longitudinal axis extending there through. The ultra-hard material body may have a side surface extending around a cutting face and defining a cross-sectional shape of the ultra-hard material body, where the side surface has at least one edge. The side surface of an ultra-hard material body may have at least one edge with an inner angle of less than 180 degrees, such that the cross-sectional shape of the ultra-hard material body along a plane transverse to the longitudinal axis has a protrusion or peak shape formed by the edge.

Figure 3:
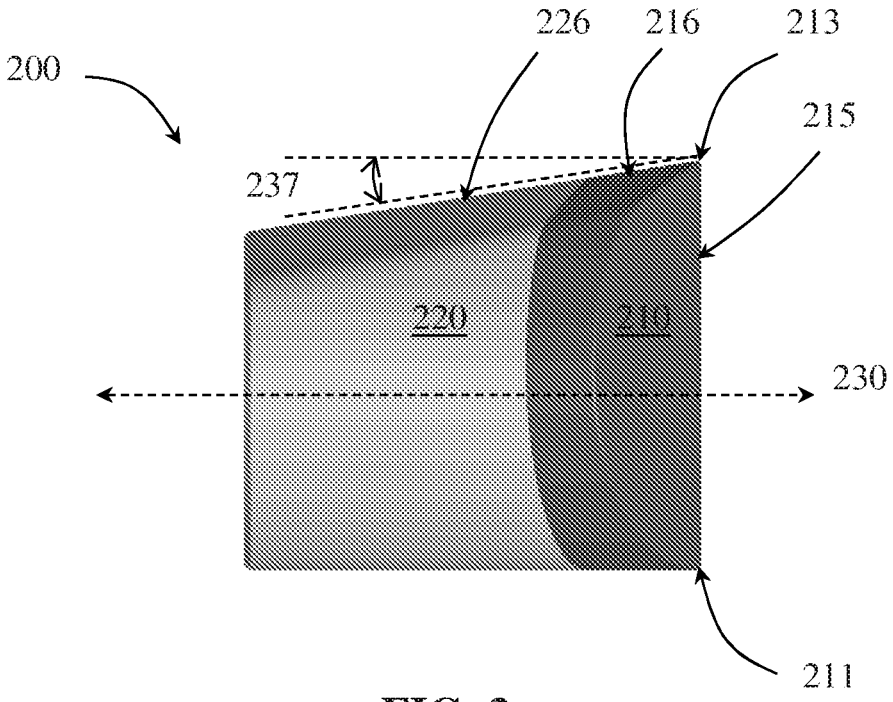
FIG. 3 shows a side view of a cutting element according to embodiments of the present disclosure.
Figure 4:
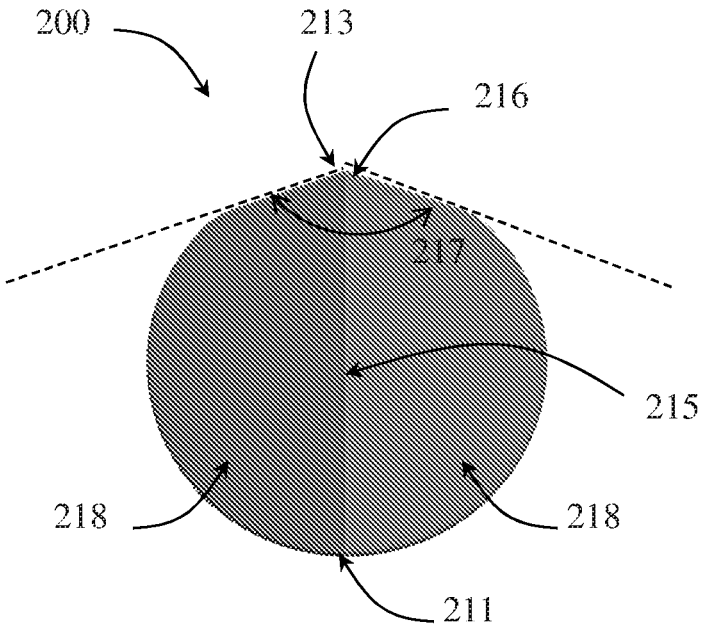
FIG. 4 shows a front view of a cutting element according to embodiments of the present disclosure.
Figure 5:
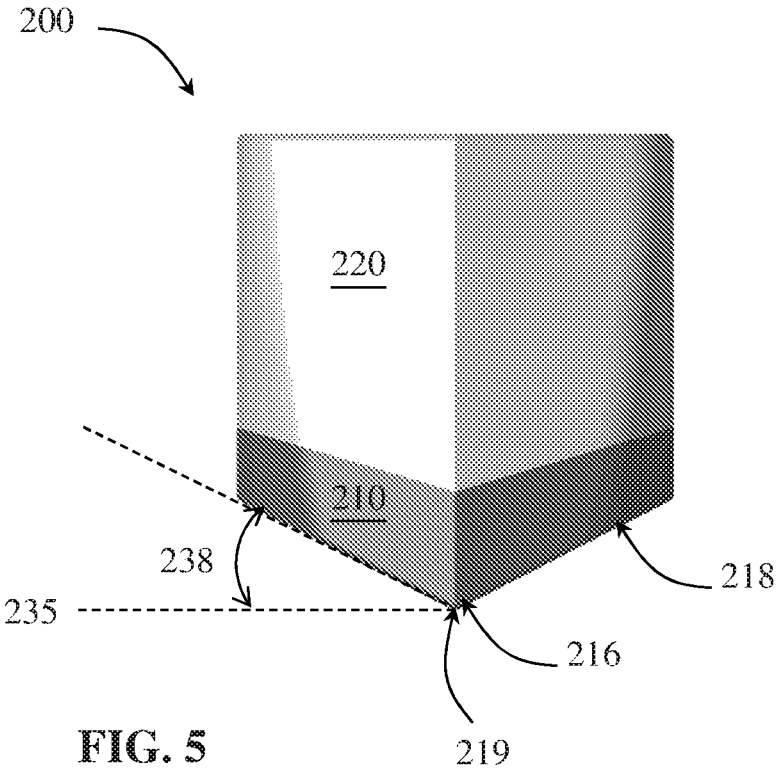
FIG. 5 shows a top view of a cutting element according to embodiments of the present disclosure.

For example, referring now to FIGS. 2-5, a perspective view, side view, front view and top view, respectively, of a cutting element according to embodiments of the present disclosure is shown. Cutting element 200 has an ultra-hard material body 210 disposed on a non-cylindrical substrate 220 and a longitudinal axis 230 extending there through. As shown in FIG. 5, the ultra-hard material body 210 may be attached to the non-cylindrical substrate 220 at a non-planar interface corresponding in shape with the non-planar cutting face 214. However, in some embodiments, an ultra-hard material body may be attached to a substrate at a planar or non-planar interface, where the interface may or may not correspond in shape with the cutting face of the ultra-hard material body.

The ultra-hard material body 210 has a side surface 212 extending around a cutting face 214 and defining a cross-sectional shape of the ultra-hard material body along a plane transverse to the longitudinal axis 230. As used herein, the side surface of an ultra-hard material body refers to the surface that defines the outermost periphery of the ultra-hard material body. Further, the cutting face refers to the one or more surfaces that define the three dimensional geometry of the cutting end which engages the formation. As shown in FIG. 4, the side surface 212 has at least one edge 216 with an inner angle 217 of less than 180 degrees, such that the cross-sectional shape of the ultra-hard material body along a plane transverse to the longitudinal axis has a protrusion or peak shape formed by the edge. In one or more embodiments, shown in FIG. 7, the ultra-hard material body 210 may have a cross-sectional shape along a plane transverse to the longitudinal axis that includes at least a first portion 232 that has a substantially constant radius $r_1$ from the longitudinal axis 230 to the side surface 212 and a second portion 234 that has a varying radius $r_2$ from the longitudinal axis 230 to the surface 212. As illustrated, the varying radius $r_2$ may, along a portion of second portion 234, be less than substantially constant $r_1$, and may be at its peak value at edge 216. However, in some embodiments, the varying radius $r_2$ may, along a portion of second portion 234, be greater than substantially constant $r_1$, and may be at its peak value at edge 216. In one or more embodiments, the cross-section of the side surface 212 along second portion 234 may form linear or substantially linear segments, concave segments, convex segments, or combinations thereof. According to some embodiments, an ultra-hard material body side surface may have one edge or more than one edge, where each edge forms an inner angle ranging from less than 180 degrees, less than 150 degrees, less than 120 degrees, less than 90 degrees or less than 60 degrees, and in some embodiments, greater than 45 degrees, 60 degrees, 90 degrees, or 120 degrees, where any lower limit can be used in combination with any upper limit. Although shown as an angular transition in FIGS. 2-5, an edge may have an angular transition or a curved transition between the two sides forming the inner angle.

Figure 2:
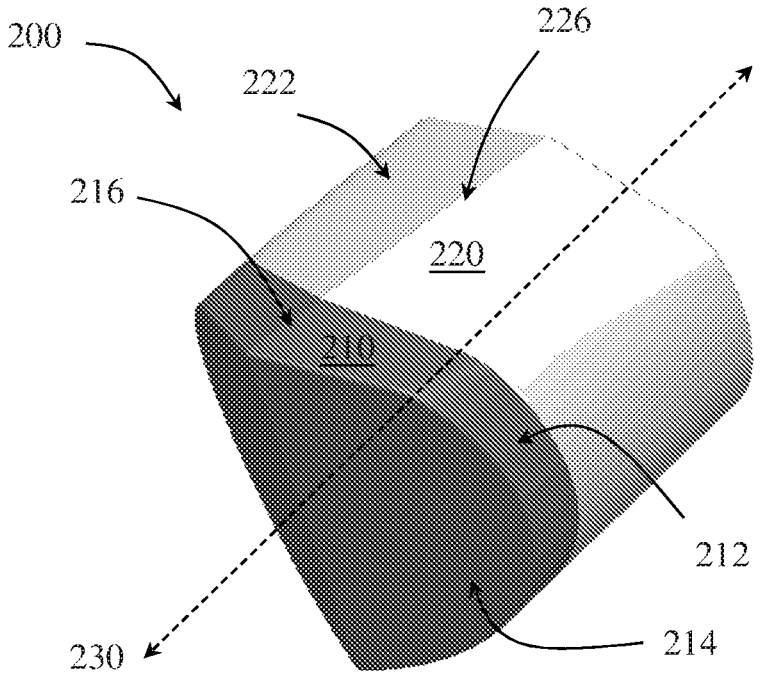
FIG. 2 shows a perspective view of a cutting element according to embodiments of the present disclosure.

As shown in FIGS. 2, 3 and 5, a non-cylindrical substrate also has a side surface 222 defining a cross-sectional shape of the substrate along a plane transverse to the longitudinal axis 230. The substrate side surface 222 may have at least one edge 226 with an inner angle aligning with the edge 216 of the ultra-hard material body 210, such that the cross-sectional shape of the ultra-hard material body 210 along a plane transverse to the longitudinal axis is substantially the same as the cross-sectional shape of the non-cylindrical substrate 220 along a plane transverse to the longitudinal axis 230. However, in other embodiments, a cross-sectional shape of the substrate along a plane transverse to the longitudinal axis may be different than the cross-sectional shape of the ultra-hard material body attached to the substrate. Referring to FIG. 3, the size of the cross-sectional shape of the ultra-hard material body and substrate may increase along the longitudinal axis 230 such that the aligned ultra-hard material body edge 216 and non-cylindrical substrate edge 226 forms an angle 237 with a line parallel to the longitudinal axis 230. In other words, cutting element 200 has an edge 216, 226 formed along the side surface of the non-cylindrical substrate and ultra-hard material body, where the cross-sectional area between the edge 216, 226 of the cutting element continuously increases along the longitudinal axis 230 from a base (or distal end) of the substrate to the ultra-hard material body. Further, edge 216, 226 may be radiused or sharp. In embodiments having a radiused edge, the radius of curvature may range, for example, up to 0.050, 0.040, 0.030, or 0.020 inches (e.g., between 0.10 and 0.50 inches). While edge 216, 226 is illustrated as extending linearly, in some embodiments, edge 216, 215 is non-linearly extending, and may include, for example, one or more discontinuities or curved portion(s).

An angle 237 formed between the edge 216, 226 and a line parallel with the longitudinal axis 230 may range, for example, from a limit of greater than 0 degrees, 10 degrees, 15 degrees, 30 degrees, 45 degrees, 60 degrees or 75 degrees, where any limit may be used in combination with any other limit (e.g., greater than 0 degrees to 60 degrees). While the angle of the combined edge 216 and 226 are shown as being continuous, the angle may be discontinuous, curved, etc., and at least one edge (e.g., the edge of the body 210) may extend substantially parallel with the longitudinal axis. In some embodiments, as shown in FIG. 3, the edge may be angled (continuously or discontinuously) along a portion of the circumference of the cutting element. In other embodiments, the edge may be angled along the entire circumference of the cutting element.

According to embodiments of the present disclosure, cutting elements may have a non-planar cutting face formed at an outer surface of the ultra-hard material layer. For example, as shown in FIGS. 2-5, a non-planar cutting face 214 is defined by at least two intersecting surfaces 218. The intersecting surfaces 218 form a linear peak 215 extending a width of the cutting face, from a first portion 211 of the side surface 212 to a second portion 213 of the side surface 212. In other embodiments, a cutting element may have a linear peak extending a chord across a cutting face or other path less than the entire width, from one portion of the side surface to another portion of the side surface. In yet other embodiments, the peak 215 may be non-linear and may include, for example, a discontinuity or be curved in its extension along the cutting face.

The intersecting surfaces 218 slope away from the linear peak 215 at an angle 238 from a plane 235 transverse to the longitudinal axis 230. According to some embodiments of the present disclosure, the angle 238 may range, for example from 5 to 45 degrees. However, in some embodiments, the angle 238 may be greater than 45 degrees. Further, the intersecting surfaces 218 may have a radiused edged or a sharp or angled edge. In embodiments having a radiused edge, the radius of curvature may range, for example, from about 0.02 inch to about 0.12 inch.

Figure 6:
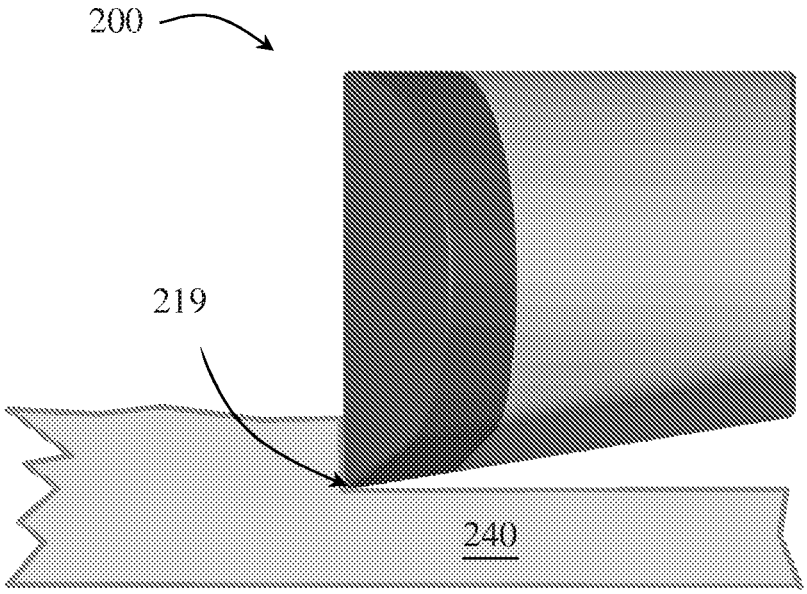
FIG. 6 shows a side view of a cutting element according to embodiments of the present disclosure.
Figure 7:
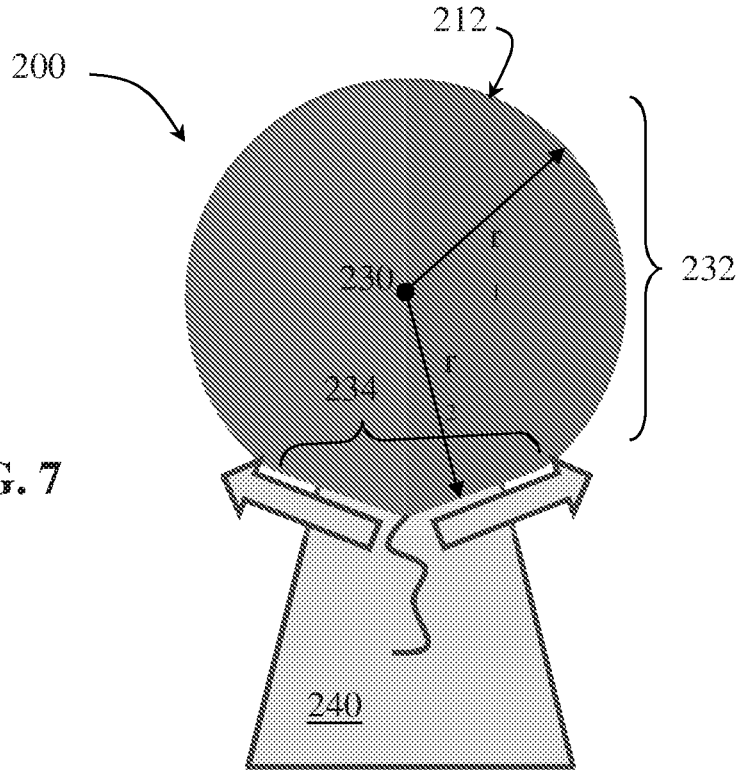
FIG. 7 shows a front view of a cutting element according to embodiments of the present disclosure.

As shown, the linear peak 215 may extend from a first portion 211 of the side surface 212 to a second portion 213 of the side surface 212, where the second portion 213 of the side surface is at edge 216 formed along the side surface 212. The intersection of the linear peak 215 with the edge 216 may form a cutting tip 219. FIGS. 6 and 7 show a side and front view, respectively, of cutting element 200 as it cuts a formation 240. As shown, cutting element 200 may be positioned on a cutting tool (not shown) such that the cutting tip 219 contacts and plows through the formation 240. The intersecting edges and sloping surfaces forming the cutting tip may facilitate drilling the formation by pre-stressing the formation and simultaneously moving the formation away from the drilling hole bottom. Such cutting tips may be used, for example, to drill soft or plastic formations.

Further, the cross-sectional shape of the ultra-hard material body 210 defined by the side surface 212 may be different from a cross-sectional shape of the ultra-hard material body 210 formed along the non-planar cutting face 214. For example, as shown in FIGS. 2-5, a side surface 212 of an ultra-hard material body 210 may define a generally tear-drop cross-sectional shape along a plane transverse to the longitudinal axis 230, while cross-sectional shapes of the ultra-hard material body 210 along the non-planar cutting face 214 (where the cross-sectional shape along the non-planar cutting face is defined by the surfaces 218 forming the non-planar cutting face 214 in combination with portions of the side surface 212) may be a rectangle or polygon with at least one curved side.

Figure 8:
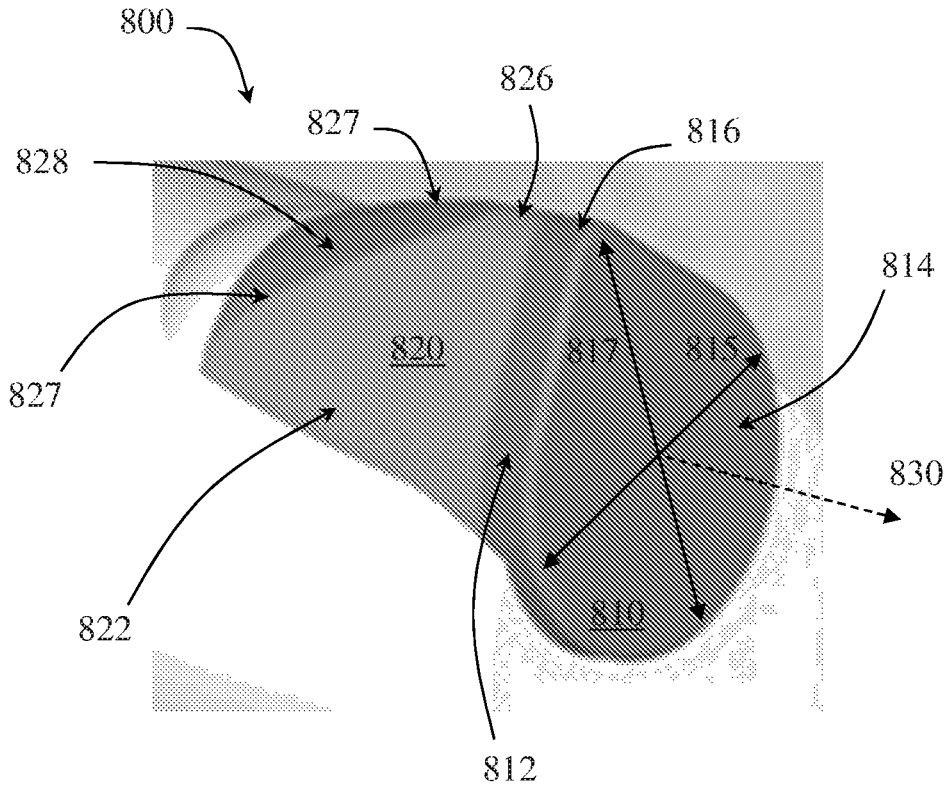
FIG. 8 shows a cutting element according to embodiments of the present disclosure.

FIG. 8 shows another cutting element according to embodiments of the present disclosure. The cutting element 800 has an ultra-hard material body 810 on a non-cylindrical substrate 820 and a longitudinal axis 830 extending there through, where the ultra-hard material body 810 has a side surface 812 extending around a cutting face 814 and defining a cross-sectional shape of the ultra-hard material body. The side surface 812 has an edge 816 (formed by portions of the ultra-hard material body 810 having different radii from the longitudinal axis 830 to the side surface 812, as described above) with an inner angle of less than 180 degrees. Particularly, the edge 816 is formed by two intersecting and substantially planar walls of the side surface 812, where the walls intersect at the inner angle and where the intersection includes a curved or radiused transition. According to some embodiments, a radiused transition may have a radius of curvature ranging from, for example, about 0.05 inch to about 0.12 inch. In other embodiments, the intersection of two walls of a side surface may include an angled transition. The inner angle of the edge 816 may range, for example, from about 90 degrees to about 150 degrees. A non-planar, curved wall extends from one of the planar walls to the other planar wall, such that the cross-sectional shape of the ultra-hard material body 810 along a plane transverse to the longitudinal axis is tear-drop shape. The cutting face 814 further has a width 815 and a length 817, where the width 815 is measured between the curved wall portion at the widest dimension of the cutting face 814, and where the length 817 is measured between the edge 816 and an opposite portion of the curved wall, along the longest dimension of the cutting face 814. The length of the cutting face may be less than its width or, in some embodiments, the length of the cutting face may be greater than its width, such that the ratio of the length 817 to width 815 is at least 1.2:1, 1.35:1, or at least 1.5:1. For example, the distance between the longitudinal axis 830 and edge 816 along the cutting face length 817 may larger than the width 815 by an amount ranging from 25 to 40 percent of the width 815 in some embodiments, and in other by an amount greater than 40 percent of the width 815. As shown, the cutting face 814 is planar, where the cross-sectional shape of the ultra-hard material body 810 at the cutting face is the same as the cross-sectional shape defined by the side surface 812.

Further, cutting element 800 has an ultra-hard material body 810 with a cross-sectional shape that is uniform along the longitudinal axis 830 (the entire thickness of the ultra-hard material body 810), while the non-cylindrical substrate 820 has a cross-sectional shape that varies along the longitudinal axis 830. As shown, the non-cylindrical substrate 820 has an outer side surface 822 defining the cross-sectional shape of the substrate and having at least one edge 826, 827 formed along at least a portion of the substrate's axial length at its periphery. The outer side surface 822 further has a sloping surface 828 between the edges 826, 827, where the sloping surface 828 slopes downwardly from the edge 826 and is bordered by edges 827. The sloping surface 828 may slope downwardly from the edge 826 at an angle ranging from, for example, about 5 degrees to about 25 degrees.

The cross-sectional shape of the non-cylindrical substrate along the edge 826 is the same as and aligns with the cross-sectional shape of the ultra-hard material body 810, while the cross-sectional shape of the non-cylindrical substrate along the remaining portion of the non-cylindrical substrate is different than the cross-sectional shape of the ultra-hard material body 810. In other words, the non-cylindrical substrate 820 has a first cross-sectional shape along a first plane transverse to the longitudinal axis 830 and intersecting the edge 826 and a second cross-sectional shape along a second plane transverse to the longitudinal axis 830 and intersecting edges 827, where the first and second cross-sectional shapes are different from each other. However, according to embodiments of the present disclosure, a non-cylindrical substrate may have the same cross-sectional shape along its entire height, or may have more than two different cross-sectional shapes along its height. Further, it is also envisioned that a non-cylindrical substrate may have a first cross-sectional shape that is non-circular (causing the first portion of the substrate to be non-cylindrical) and a second cross-sectional shape that is circular (thus, leading to a second portion of the substrate that is cylindrical).

Figure 9:
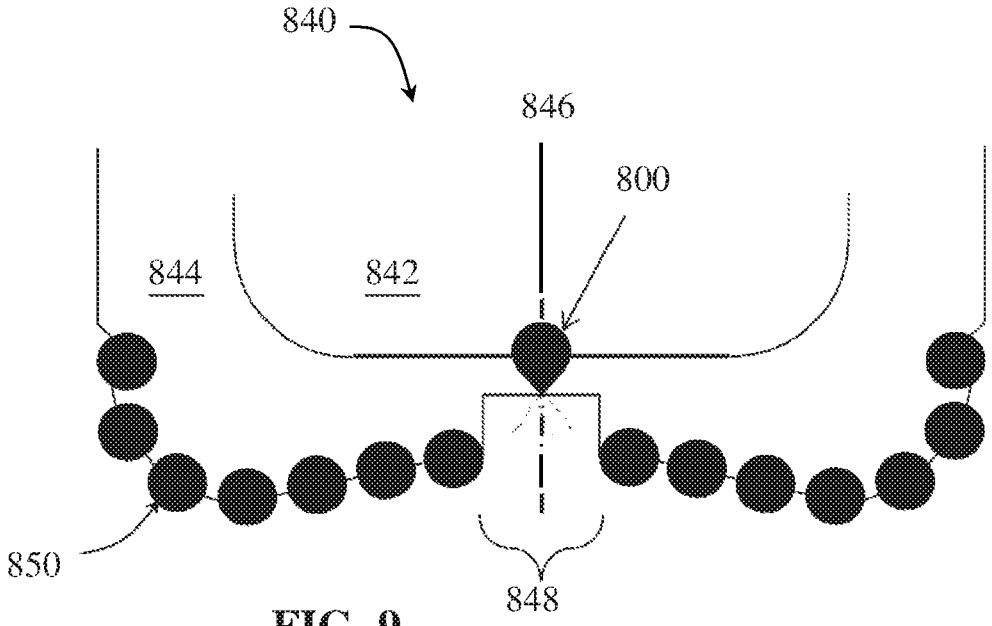
FIG. 9 shows a schematic sectional view of a cutting tool according to embodiments of the present disclosure.
Figure 10:
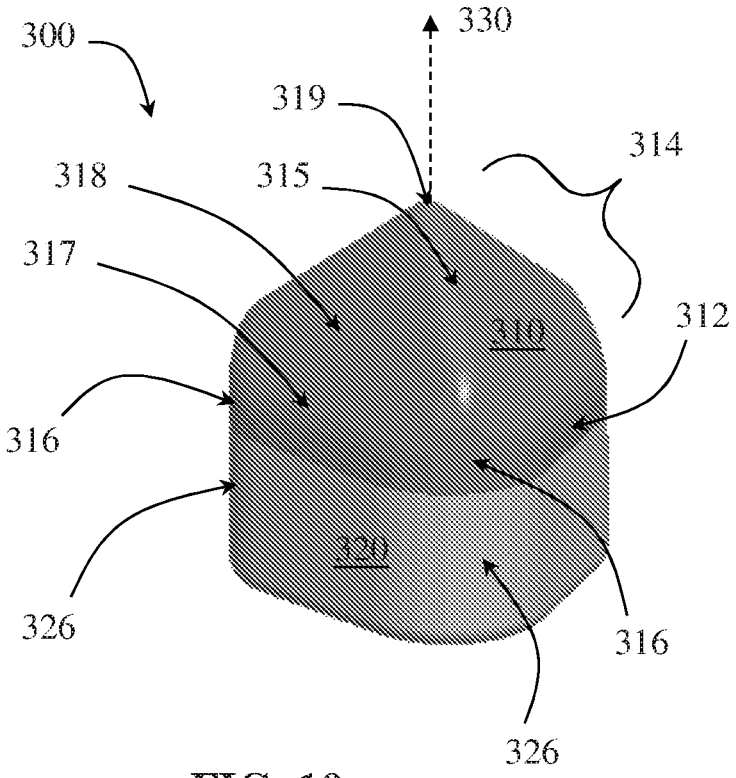
FIG. 10 shows a perspective view of a cutting element according to embodiments of the present disclosure.
Figure 11:
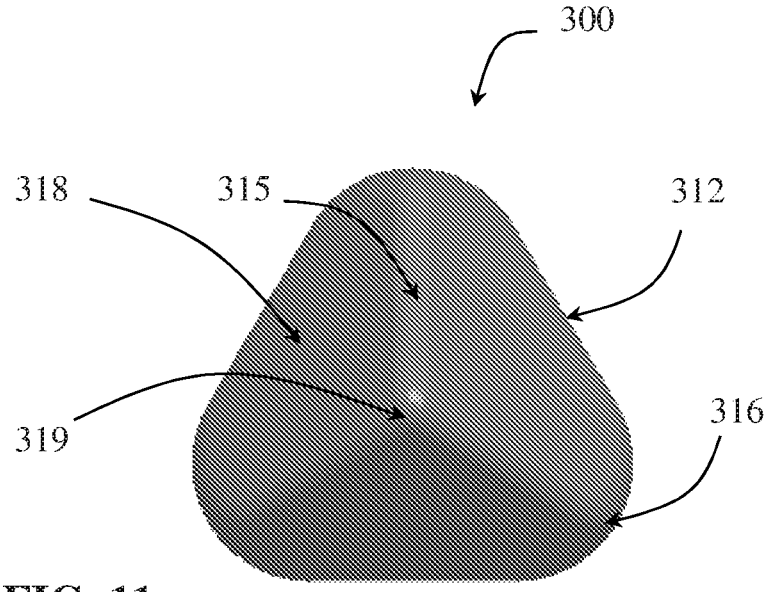
FIG. 11 shows a top view of a cutting element according to embodiments of the present disclosure.
Figure 12:
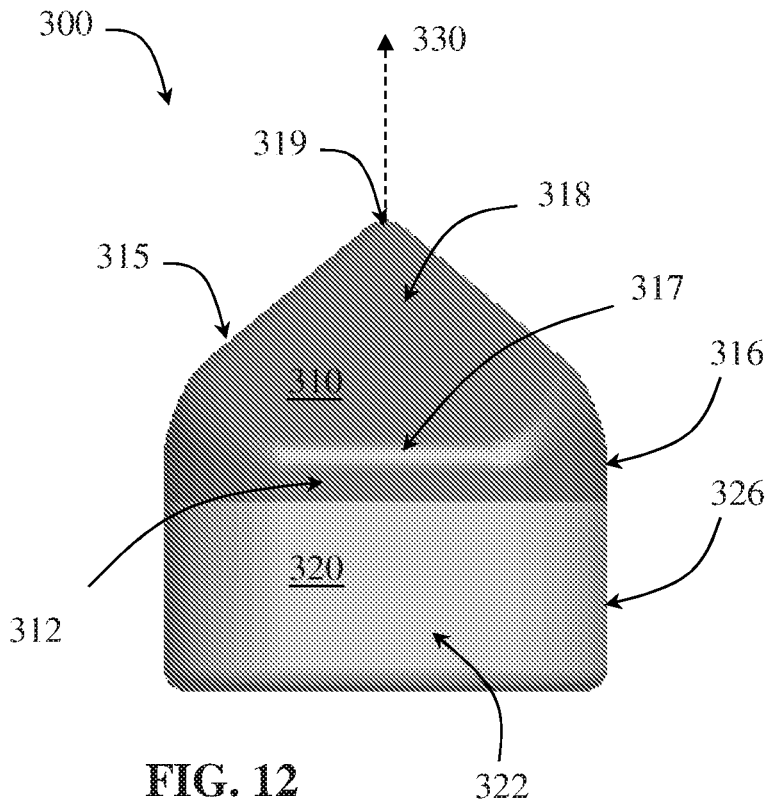
FIG. 12 shows a side view of a cutting element according to embodiments of the present disclosure.
Figure 13:
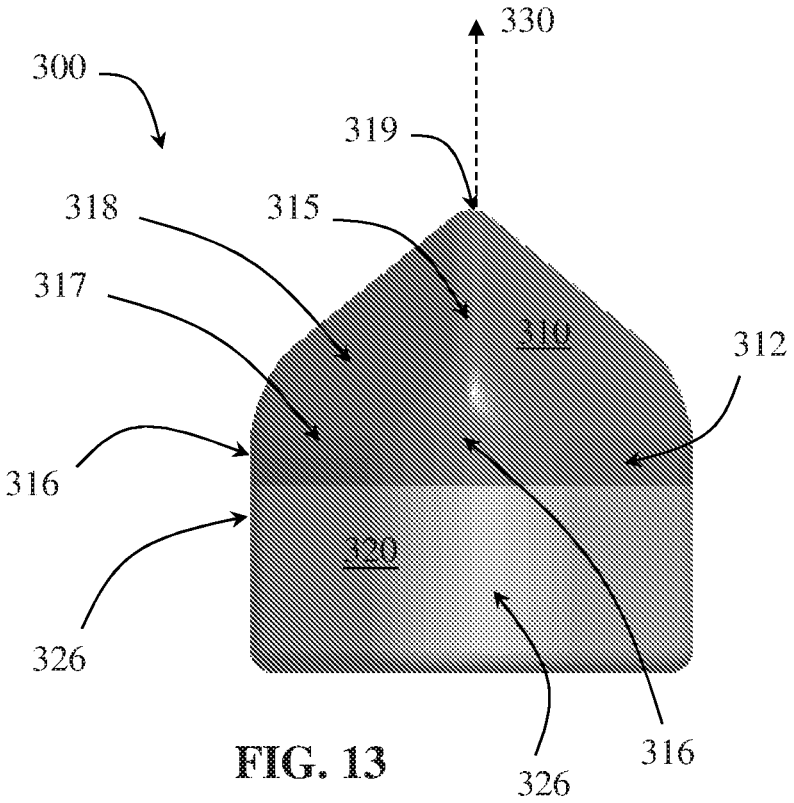
FIG. 13 shows a side view of a cutting element according to embodiments of the present disclosure.
Figure 14:
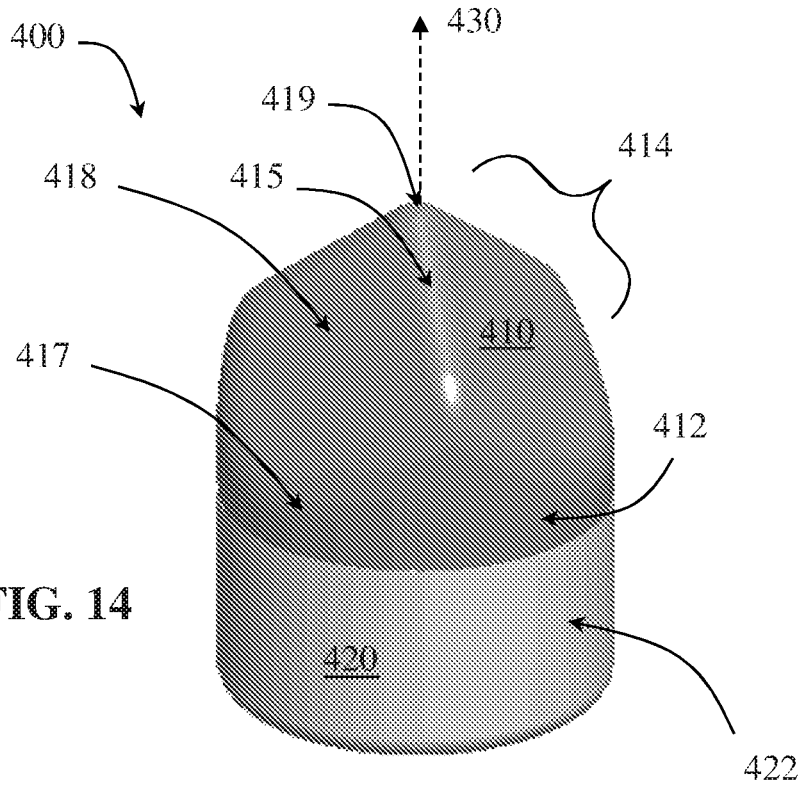
FIG. 14 shows a perspective view of a cutting element according to embodiments of the present disclosure.
Figure 15:
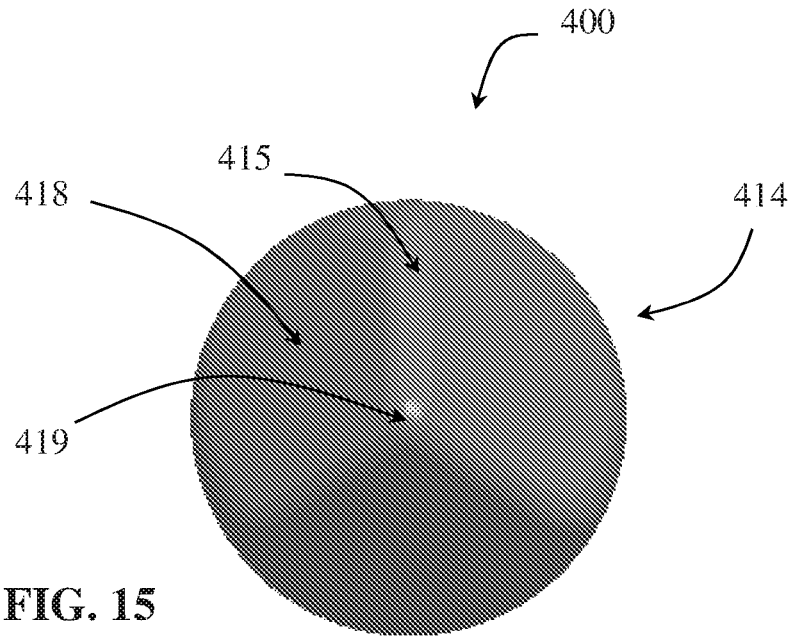
FIG. 15 shows a top view of a cutting element according to embodiments of the present disclosure.
Figure 16:
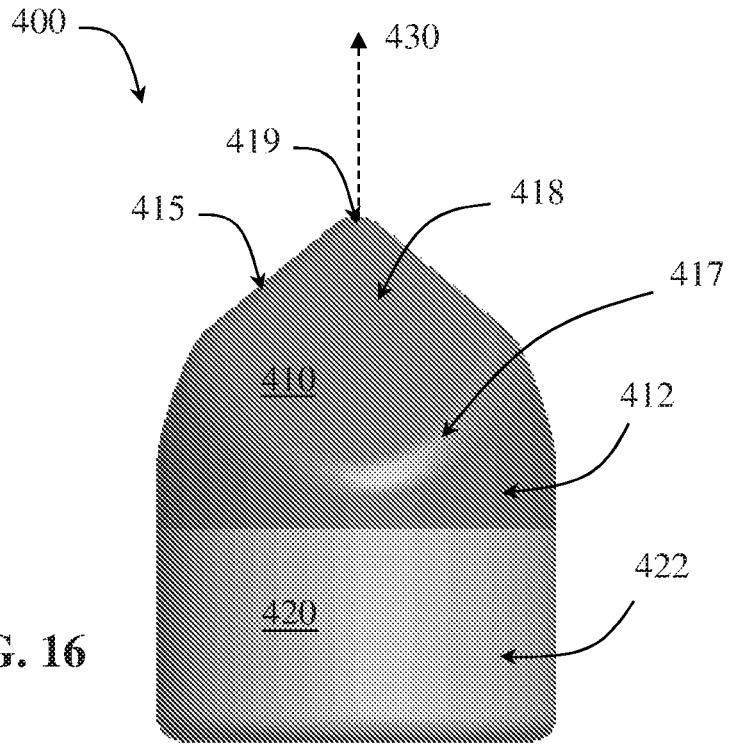
FIG. 16 shows a side view of a cutting element according to embodiments of the present disclosure.
Figure 17:
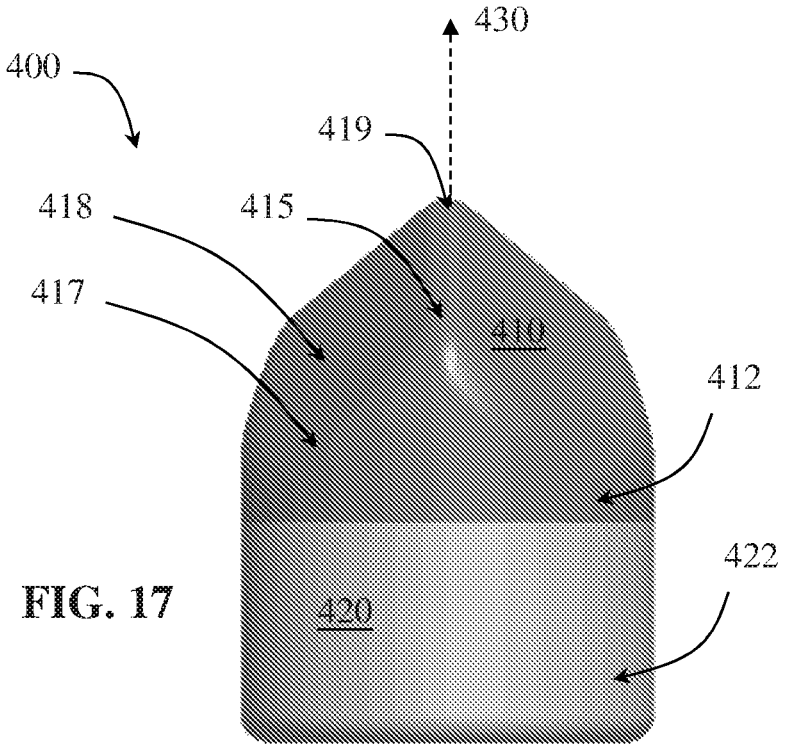
FIG. 17 shows a side view of a cutting element according to embodiments of the present disclosure.

Referring now to FIG. 9, a schematic sectional view of a drill bit cutting tool is shown, where the drill bit has cutting element 800 positioned thereon to contact and cut a formation. The drill bit 840 has a body 842, at least one blade 844 extending outwardly from the body 842, and a central axis 846, where the blades 844 converge towards a central region 848 around the central axis 846. A plurality of cutting elements 850 are disposed along a cutting edge of each blade 844, and cutting element 800 is disposed on the tool body between the plurality of blades in the central region 848. The cutting element 800 is positioned in the central region 848 to act as a coring element, such that the edge 816 (shown in FIG. 8) of cutting element 800 may contact and core the central region of a bottom hole being drilled. In one embodiment, the cutting element used in the central region 848 may be of the type illustrated in FIG. 8; however, other embodiments may use the cutting element of the type illustrated in FIGS. 2-5 or other cutting elements with three dimensional shapes such as those described throughout this application.

FIGS. 10-13 show a perspective view, a top view and side views, respectively, of another cutting element according to embodiments of the present disclosure. The cutting element 300 has an ultra-hard material body 310 disposed on a non-cylindrical substrate 320 at a planar or non-planar interface, and a longitudinal axis 330 extending there through, where the ultra-hard material body 310 has a side surface 312 extending around a cutting face 314 and defining a cross-sectional shape of the ultra-hard material body. The side surface 312 has at least one edge 316 with an inner angle of less than 180 degrees, where the side surface defines a substantially triangular cross-section shape (e.g., with rounded corners) of the ultra-hard material body 310. In one or more embodiments, the ultra-hard material body 310 may have a cross-sectional shape along a plane transverse to the longitudinal axis 330 that includes a varying radius from the longitudinal axis to the side surface 312 around the entire periphery of ultra-hard material body 310. A plurality of sloping surfaces 318 and linear peaks 315 or ridges define a non-planar cutting face 314, where each linear peak 315 extends from each edge 316 to a cutting tip 319 and where the sloping surfaces 318 slope downwardly from the linear peaks 315 to intersect 317 with the side surface 312 extending between edges 316. The linear peaks 315 may slope downwardly at an angle ranging between 30 degrees and 60 degrees relative to the longitudinal axis 330. Further, the ultra-hard material body 310 may have a height measured between the cutting tip 319 and the base of the ultra-hard material body, or interface with substrate 320, where the height may range from about 0.1 inch to about 0.625 inch, depending on, for example, the total height of the cutting element, the angle of slope of the linear peaks, and the material used to form the ultra-hard material body. As shown in FIGS. 10-13, the linear peaks and sloping surfaces may form a triangular pyramid shaped cutting face; however, in other embodiments, a non-planar cutting face may be shaped as a different polygonal pyramid, for example, a rectangular pyramid, a pentagonal pyramid or a hexagonal pyramid. Further, intersecting surfaces forming a non-planar, non-conical cutting face may include angled, curved or faceted transitions. For example, as shown in FIGS. 10-13, the intersections 317 between sloping surfaces 318 and side surface 312 has a curved transition, and the linear peaks 315 form curved transitions between the intersecting sloping surfaces 318. In other embodiments, intersections between adjoining surfaces may have angled transitions, or curved transitions with smaller radii of curvature. According to some embodiments, intersections between adjoining surfaces may have a radius of curvature ranging from about 0.02 to 0.125 inch. In yet other embodiments, intersecting sloping surfaces forming a non-planar cutting face may be faceted, where a transition surface extends between adjacent sloping surfaces.

A cutting element having a pyramidal cutting face may have a corresponding non-cylindrical substrate or a non-corresponding substrate. For example, as shown in FIGS. 10-13, a non-cylindrical substrate 320 has an outer side surface 322 with at least one edge 326. The outer side surface 322 of the non-cylindrical substrate 320 defines a triangular cross-section shape of the non-cylindrical substrate 320 corresponding with the triangular cross-section shape of the ultra-hard material body 310, where edges 326 of the non-cylindrical substrate 320 align with edges 316 of the ultra-hard material body. The linear peaks 315 forming the pyramidal cutting face align with edges 316 and 326 such that the pyramidal cutting face has a base shape corresponding with the cross-sectional shape of the non-cylindrical substrate 320 and ultra-hard material body 310. In one or more embodiments, the substrate 320 may have a cross-sectional shape along a plane transverse to the longitudinal axis 330 that includes a varying radius from the longitudinal axis to the side surface 322 around the entire periphery of substrate 320.

Referring now to FIGS. 14-17, an example of a cutting element having a pyramidal cutting face and a non-corresponding substrate is shown. The cutting element 400 has an ultra-hard material body 410 disposed on a substrate 420 at a planar or non-planar interface, and a longitudinal axis 430 extending axially therethrough, where the ultra-hard material body 410 has a side surface 412 extending around a cutting face 414 and defining a cross-sectional shape of the ultra-hard material body along a plane perpendicular to the longitudinal axis 430. The side surface 412 (radially outermost periphery) of the ultra-hard material body and the outer side surface 422 of the substrate define corresponding circular cross-sectional shapes without having an edge. A plurality of sloping surfaces 418 and linear peaks 415 define a non-planar cutting face 414, where each linear peak 415 extends from the side surface 412 to a cutting tip 419 and where the sloping surfaces 418 slope downwardly from the linear peaks 415 to intersect 417 with the side surface 412. The linear peaks 415 may have a radiused edge, with a radius of curvature ranging from about 0.02 to 0.125 inch. Further, the linear peaks 415 may slope downwardly at an angle ranging between 30 degrees and 60 degrees relative to the longitudinal axis 430. A height of the ultra-hard material body 410 is measured between the cutting tip 419 and the base of the ultra-hard material body, or interface with substrate 420, where the height may range from about 0.1 inch to about 0.625 inch. The linear peaks 415 and sloping surfaces 418 form a triangular pyramidal shape (a pyramid shape having a triangular base), such that a cross-sectional shape of the ultra-hard material body along the cutting face 414 is triangular, while a cross-sectional shape of the ultra-hard material body along the side surface 412 is circular. However, in other embodiments, an ultra-hard material body may have different combinations of cross-sectional shapes along its cutting face and side surface. For example, an ultra-hard material body may have a polygonal pyramidal cutting face (e.g., rectangular, pentagonal or hexagonal pyramid) with a circular cross-sectional shape along its side surface, or with a polygonal cross-sectional shape along its side surface that does not align with the polygonal pyramidal cutting face.

Figure 18:
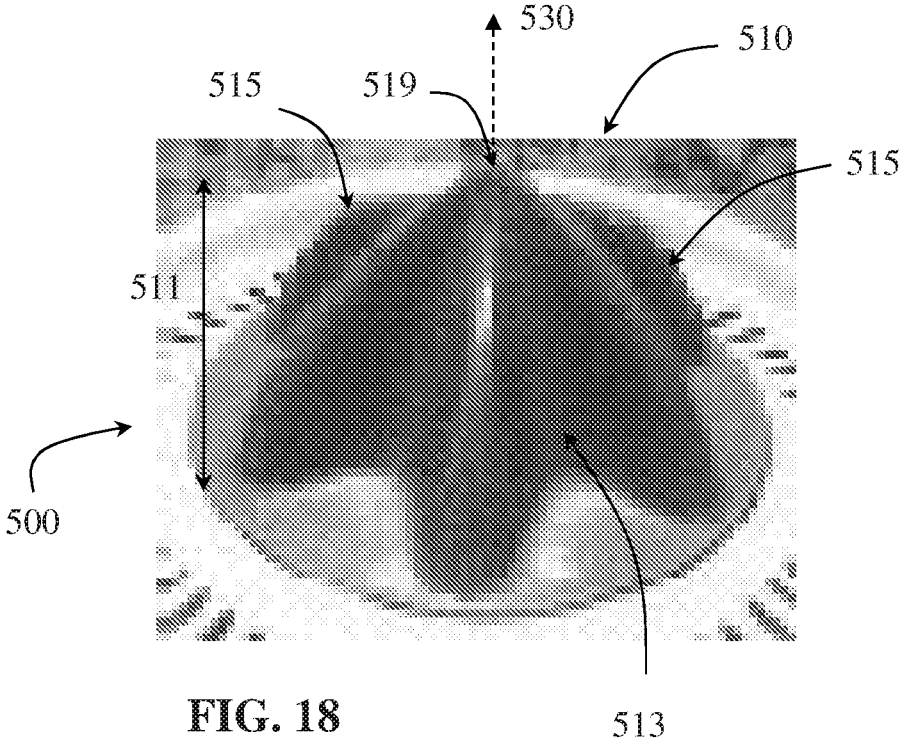
FIG. 18 shows a perspective view of an ultra-hard material body according to embodiments of the present disclosure.
Figure 19:
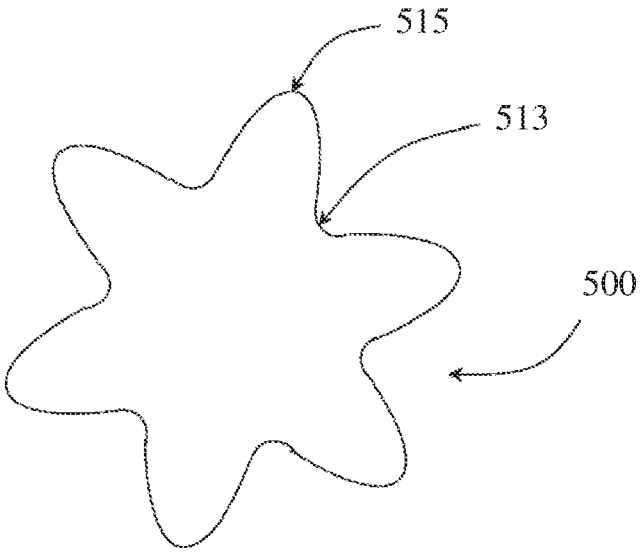
FIG. 19 shows a cross-sectional view of an ultra-hard material body according to embodiments of the present disclosure.
Figure 20:
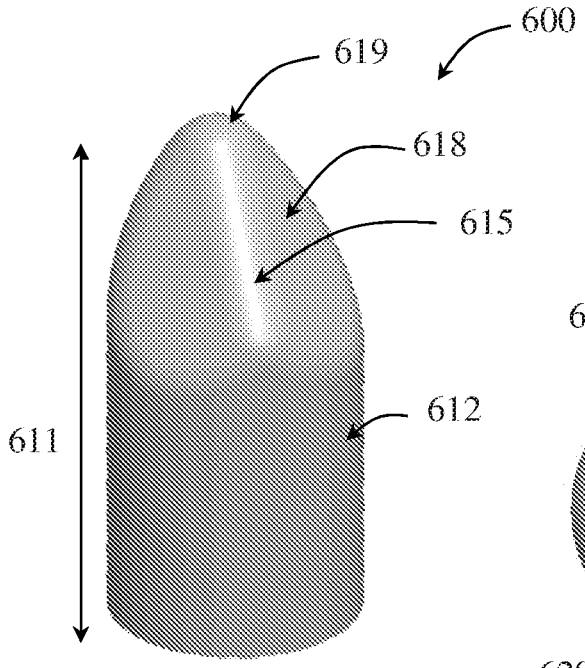
FIG. 20 shows a perspective view of a cutting element according to embodiments of the present disclosure.
Figure 21:
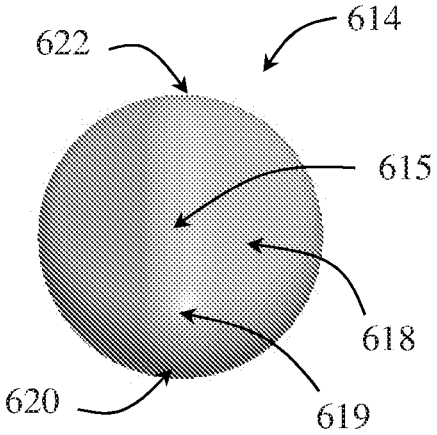
FIG. 21 shows a top view of a cutting element according to embodiments of the present disclosure.
Figure 22:
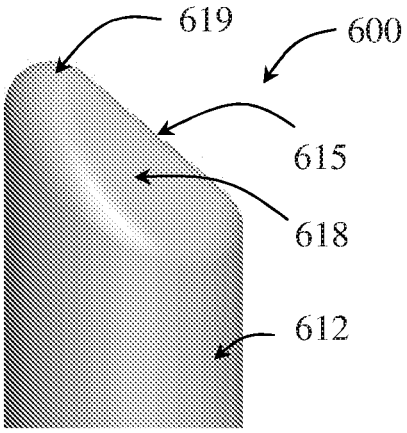
FIG. 22 shows a side view of a cutting element according to embodiments of the present disclosure.
Figure 23:
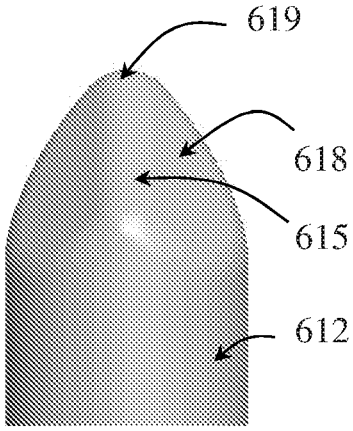
FIG. 23 shows a side view of a cutting element according to embodiments of the present disclosure.
Figure 24:
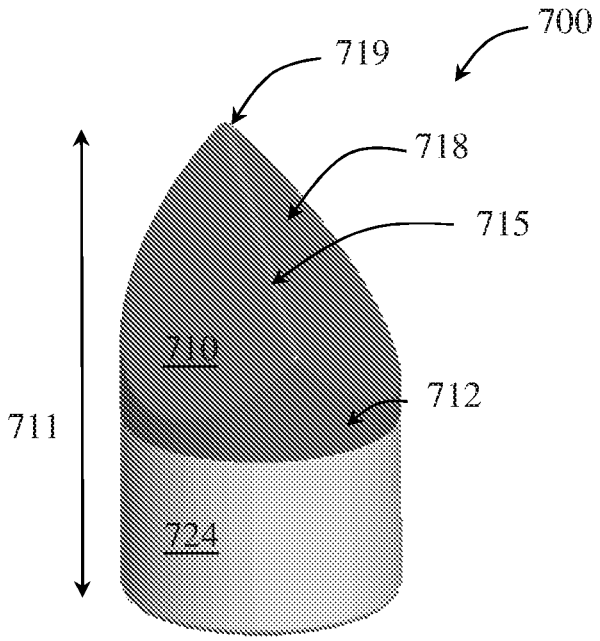
FIG. 24 shows a perspective view of a cutting element according to embodiments of the present disclosure.
Figure 25:
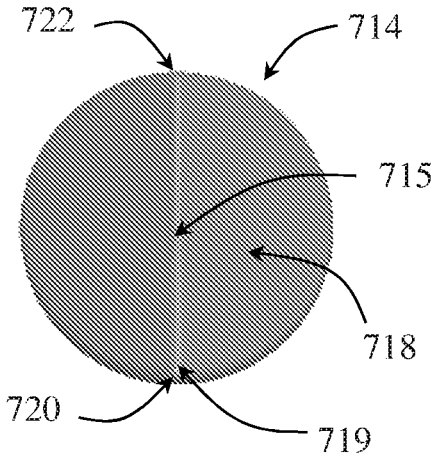
FIG. 25 shows a top view of a cutting element according to embodiments of the present disclosure.
Figure 26:
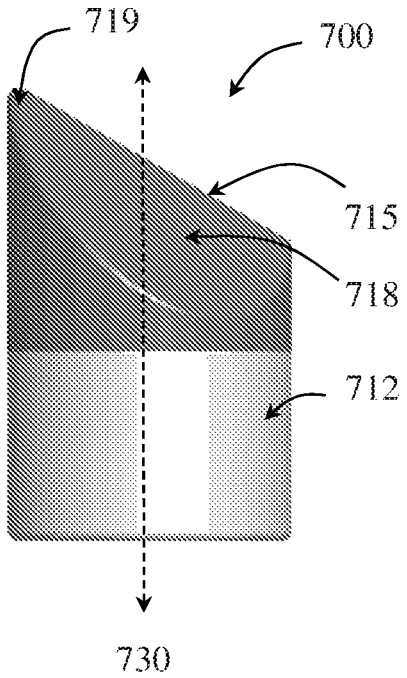
FIG. 26 shows a side view of a cutting element according to embodiments of the present disclosure.
Figure 27:
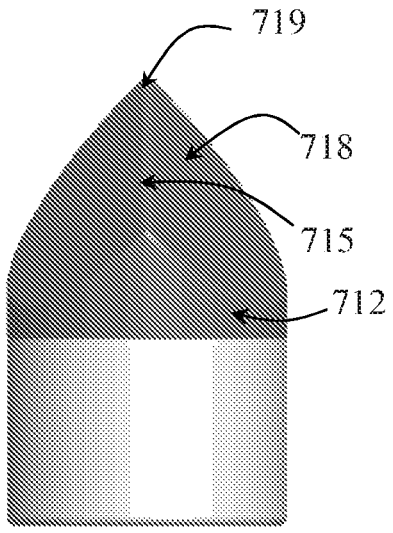
FIG. 27 shows a side view of a cutting element according to embodiments of the present disclosure.

FIGS. 18 and 19 show another example of an ultra-hard material body that may be attached to a substrate having a corresponding cross-sectional shape or a different cross-sectional shape. As shown in FIG. 18, the ultra-hard material body 500 has a non-planar cutting face 510 formed by a plurality of linear peaks 515 and a plurality of valleys 513 alternating there between. The linear peaks 515 extend upwardly from a side surface and converge at an apex to form a cutting tip 519. Between each pair of linear peaks 515 is a valley 513 extending from a base of the ultra-hard material body towards the cutting tip 519.

FIG. 19 shows a cross-sectional view of the ultra-hard material body 500 along a plane transverse to the longitudinal axis 530. The plurality of alternating linear peaks 515 and valleys 513 form a multi-lobe shaped cross-sectional shape of the ultra-hard material body 500, where the multiple lobes extend radially outward from the longitudinal axis. The valleys 513 and linear peaks 515 have rounded transitions around the points of inflection. Particularly, the valleys 513 have rounded transitions with a radius of curvature extending between neighboring linear peaks 515 (a concave shape), and the linear peaks 515 have rounded peaks with a radius of curvature (a convex shape), where the radii of curvature for the valleys and linear peaks may vary along the height 511 (shown in FIG. 18) of ultra-hard material body 500. As shown in FIG. 18, the radii of curvature of the valleys 513 and linear peaks 515 may decrease (continuously or discontinuously) from the base of the ultra-hard material body to the apex 519. Further, each valley 513 may maintain a concave shape along the entire height of each valley 513. However, according to other embodiments, a non-planar cutting face of an ultra-hard material body may have alternating linear peaks and valleys with angled transitions or a combination of angled and rounded transitions.

The embodiment shown in FIGS. 18 and 19 includes six linear peaks and valleys. However, other embodiments may have more or less than six linear peaks alternating with valleys to form an ultra-hard material body having a multi-lobed cross-sectional shape with curved transitions and/or angled transitions around the points of inflection. For example, an ultra-hard material body may have four linear peaks alternating with four valleys and extending from a base of the ultra-hard material body to converge at an apex, where the cross-sectional shape of the ultra-hard material body has four lobes extending radially outward from a central axis and may form a four-point star shape. In some embodiments, an ultra-hard material body may have five linear peaks alternating with five valleys and extending from a base of the ultra-hard material body to converge at an apex, where the cross-sectional shape of the ultra-hard material body has five lobes extending radially outward from a central axis. In some embodiments, an ultra-hard material body may have seven linear peaks alternating with seven valleys and extending from a base of the ultra-hard material body to converge at an apex, where the cross-sectional shape of the ultra-hard material body has seven lobes extending radially outward from a central axis and may form a seven-point star shape. The number of alternating linear peaks and valleys forming a non-planar cutting face may depend, for example, on the material used to form the ultra-hard material body, the size of the ultra-hard material body, the formation being drilled, the position of the cutting element on a cutting tool, and the shape of the substrate to which the ultra-hard material body is attached.

Figure 34:
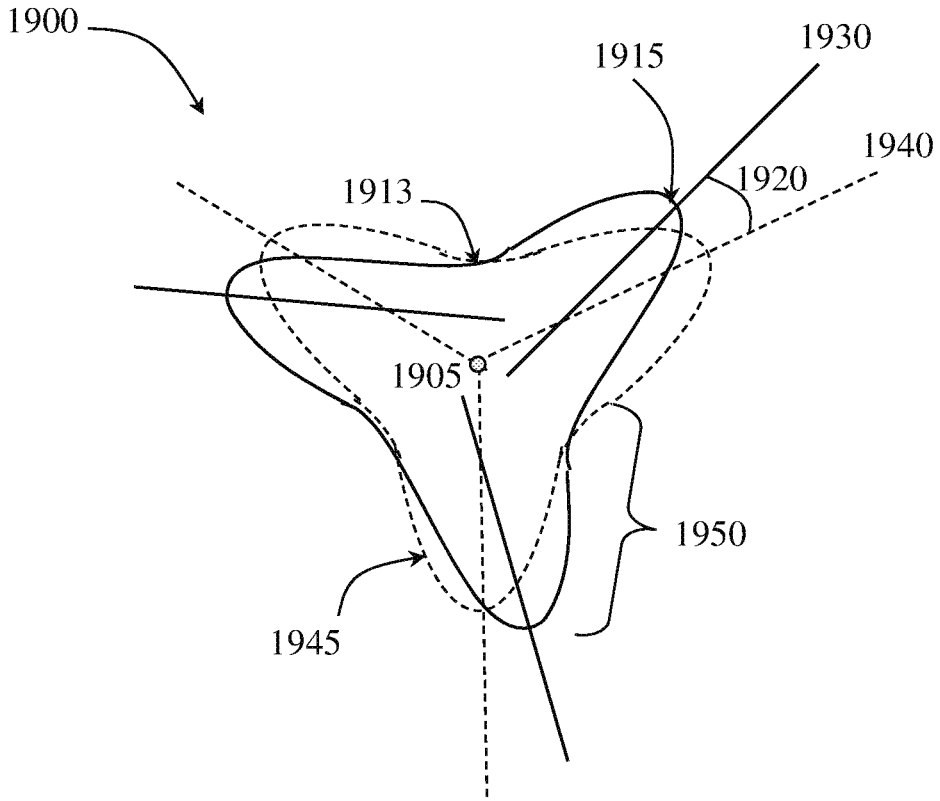
FIG. 34 shows a cross-sectional view of an ultra-hard material body according to embodiments of the present disclosure.

Further, ultra-hard material bodies having a multi-lobed cross-sectional shape may have one or more lobes that extend in a direction at an angle offset from the longitudinal axis. Referring now to FIG. 34, a cross-sectional view of an ultra-hard material body 1900 is shown, where the ultra-hard material body has a plurality of alternating linear peaks 1915 and valleys 1913 forming a multi-lobe cross-sectional shape. The cross-sectional view is along a plane transverse to the longitudinal axis 1905 of the ultra-hard material body 1900. Each lobe 1950 extends radially outward from a central region (surrounding the longitudinal axis 1905) of the ultra-hard material body in a direction that is offset from the longitudinal axis 1905. The dashed lines indicate the cross-sectional shape of the ultra-hard material body 1945 if each lobe extended in a radially outward direction 1940 from the longitudinal axis 1905, where the lobes are at a zero degree offset angle. An offset angle 1920 of each lobe 1950 may be measured between the direction 1940 extending outward from the longitudinal axis and a lobe plane 1930, where the lobe plane 1930 extends longitudinally through the lobe and radially along the direction of the lobe, intersecting the linear peak 1915 of the lobe. According to embodiments of the present disclosure, one or more lobes may extend outwardly at an offset angle ranging from a lower limit of 0 degrees, 5 degrees, 15 degrees, or 30 degrees to an upper limit of 5 degrees, 15 degrees, 30 degrees, 45 degrees or 60 degrees, where any lower limit may be used in combination with any upper limit, depending on, for example, the number of lobes and the size and shape of the lobes. FIGS. 18 and 19 show an example of an embodiment having a plurality of lobes extending in a radially outward direction at a zero degree offset angle.

According to embodiments of the present disclosure, a cutting element having an ultra-hard material body with a multi-lobed cross-sectional shape, such as shown in FIGS. 18, 19 and 34, may include a substrate attached to the ultra-hard material body at an interface and a longitudinal axis extending axially there through. The ultra-hard material body may be attached to a cylindrical or a non-cylindrical substrate. For example, a cutting element may include an ultra-hard material body disposed on a substrate, where the ultra-hard material body has a non-planar outer surface with a plurality of linear peaks converging at an apex, such that the cross-sectional shape of the ultra-hard material body has a multi-lobed shape. The substrate may be a non-cylindrical substrate, having a non-circular cross-sectional shape along a plane transverse to the longitudinal axis. In other embodiments, the substrate may be a cylindrical substrate having a circular cross-sectional shape along a plane transverse to the longitudinal axis.

Referring now to FIGS. 20-23, a perspective view, a top view, and side views, respectively, of a cutting element according to embodiments of the present disclosure is shown. The cutting element 600 has a side surface 612 extending around a non-planar cutting face 614. The non-planar cutting face 614 is defined by a linear peak 615 extending the width of the cutting face 614, from a first portion 620 along the side surface 612 to a second portion 622 along the side surface 612, and sloping downwardly from a cutting tip 619 at an angle ranging between 10 and 60 degrees. As shown, the cutting tip 619 is proximate the outer periphery or side surface 612 of cutting element 600. That is, the cutting tip 619 (forming the axial uppermost portion of the cutting element 600) is laterally spaced from the longitudinal axis of the cutting element and is proximate the side surface 612. Specifically, the cutting tip 619 may be minimally spaced from the side surface 612, such as by the transition caused by the radius of curvature of the cutting tip. For example, the cutting tip 619 may have a radius of curvature ranging from about 0.02 to 0.125 inch. In some embodiments, a cutting tip may be located a distance from a central axis of the cutting element greater than 70 percent, greater than 80 percent, greater than 90 percent, or greater than 95 percent of the radius of the cutting element. In some embodiments, the cutting tip may be located a distance from the central axis that is 100 percent of the radius of the cutting element, i.e., at the side surface, where the distance from the central axis is approximately equal to the radius of the cutting element. In yet other embodiments, a cutting tip may be located a distance from the central axis that is between 15 percent and 70 percent of the cutting element radius.

Linear peak 615 extends across (e.g., at least a substantial majority or the entire) the cutting element diameter from one side of cutting element 600 to the other. That is, the first portion 620 and second portion 622 may be about 180 degrees from each other. Two sloping surfaces 618 slope downwardly from the linear peak 615 (radially or laterally outward from the extension of linear peak 615) to the side surface 612 of the cutting element 600. The axial height 611 of the cutting element along the first portion 620 of the side surface 612, at the cutting tip 619, is greater than the axial height 611 of the cutting element along the second portion 622 of the side surface 612. Further, cutting element 600 may be formed of a single material, such as a composite material, where the composition of the cutting element is uniform throughout, or a combination of materials, such as an ultra-hard material body disposed on a substrate, where the ultra-hard material body forms the cutting face.

FIGS. 24-27 show a perspective view, a top view, and side views, respectively, of a cutting element according to embodiments of the present disclosure is shown. The cutting element 700 has an ultra-hard material body 710 attached to a substrate 724, and a longitudinal axis 730 extending axially there through. The ultra-hard material body has a side surface 712 extending around a non-planar cutting face 714, where the non-planar cutting face 714 is defined by a linear peak 715 extending the width of the cutting face 714, from a first portion 720 along the side surface 712 to a second portion 722 along the side surface 712, and sloping downwardly from a cutting tip 719. Two sloping surfaces 718 slope downwardly from the linear peak 715 to the side surface 712 of the cutting element 700. Further, the axial height 711 of the ultra-hard material body 710 along the first portion 720 of the side surface 712, at the cutting tip 719, is greater than the axial height 711 of the ultra-hard material body along the second portion 722 of the side surface 712, where linear peak 715 slopes downwardly from the cutting tip 719 to the second portion 722 of the side surface. According to some embodiments of the present disclosure, a linear peak may slope downwardly from a cutting tip at an angle relative to a horizontal plane perpendicular to the longitudinal axis ranging from a lower limit of greater than 15 degrees, 30 degrees or 45 degrees to an upper limit of 30 degrees, 45 degrees, or 60 degrees, where any lower limit may be used in combination with any upper limit. In other embodiments having a linear peak extend at a 0 degree angle relative to a horizontal plane perpendicular to the longitudinal axis, the linear peak may not slope downwardly from a cutting tip. The cutting tip 719 is located adjacent the side surface 712, where the distance of the cutting tip 719 from the central axis is approximately equal to the radius of the cutting element.

Figure 28:
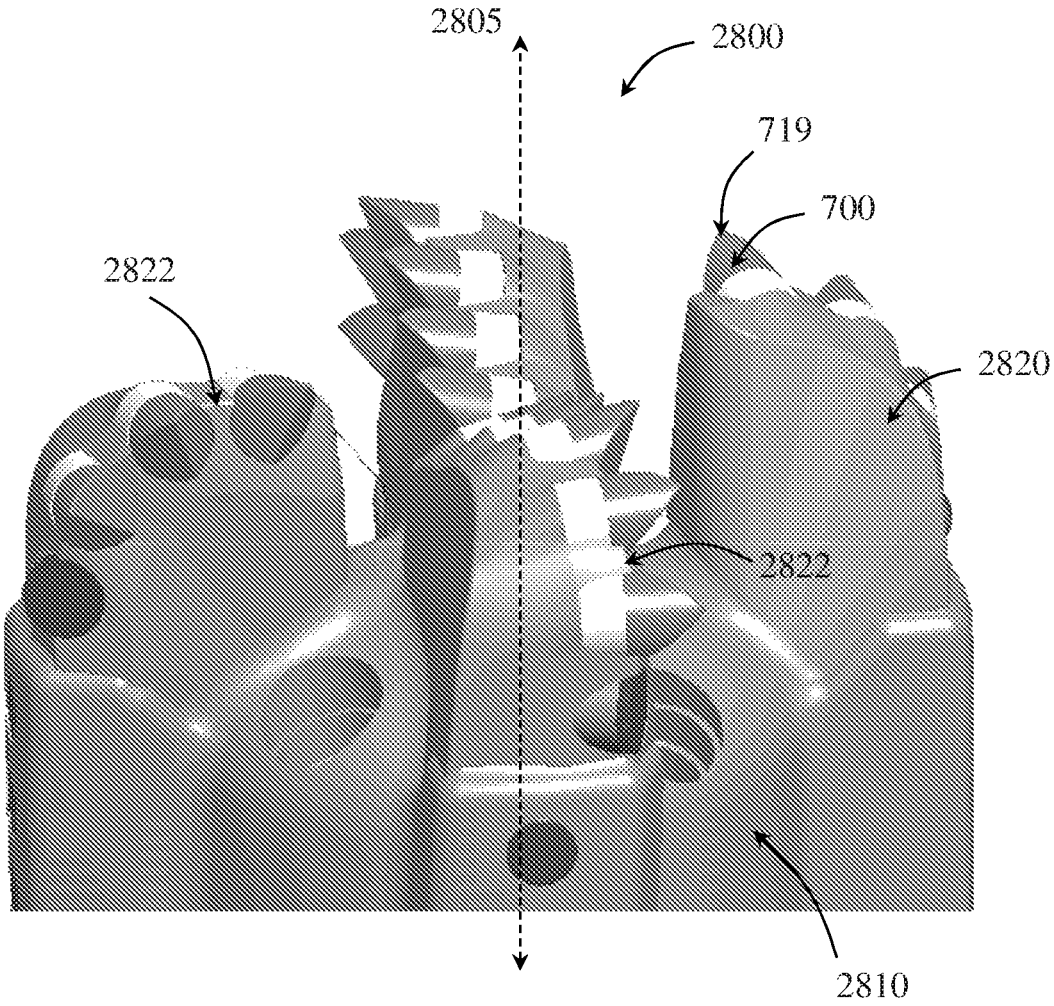
FIG. 28 shows a cutting tool according to embodiments of the present disclosure.

FIG. 28 shows a cutting tool having a cutting element according to embodiments of the present disclosure disposed thereon. The cutting tool is a drill bit 2800 having a tool body 2810, a central axis 2805 extending there through, and a plurality of blades 2820 extending outwardly from the tool body 2810 and converging towards a central region around the central axis 2805. At least one cutting element 700 (also shown in FIGS. 24-27) is attached along a cutting (or leading with respect to the direction of rotation of the bit) edge 2822 of a blade 2820, where each cutting element 700 is positioned on the blade 2820 such that the cutting tip 719 (also shown in FIGS. 24-27) contacts and cuts a formation during operation of the drill bit 2800. Particularly, each cutting element 700 is disposed on the cutting edge 2822 of the blades 2820 such that the cutting tip 719 is at or near the outermost distance from the tool body 2810 relative to the remaining portions of the cutting element. Cutting elements 700 may be oriented on the blades 2820 such that the longitudinal axes 730 of the cutting elements 700 form an angle with respect to the formation being drilled, where the angle may range from 5 to 135 degrees in some embodiments, and between 5 and 45 degrees in some particular embodiments. In some embodiments, the angle of orientation of the cutting elements may be measured with respect to a horizontal plane transverse to the tool's central axis 2805, where the linear peak 715 of cutting elements 700 may form an angle with the horizontal plane ranging from about 35 to 85 degrees. Further, while the cutting element of FIGS. 24-27 is illustrated in FIG. 28, any of the previously described cutting elements may also be used on a blade of a bit or other downhole cutting tool. Additionally, it is also within the scope of the present disclosure that any of the described embodiments may be spaced rearward of the leading edge or side of the bit, in a position often referred to as backup or secondary cutting element. Further, any of the cutting elements may be used alone or in combination with other types of cutting elements, including, for example shear cutters having a planar cutting face and cylindrical ultra-hard material body and substrate.

Further, an ultra-hard material body having a non-planar cutting face defined by at least one linear peak, for example, the non-planar cutting faces shown in FIGS. 2-7, 10-19 and 24-27 may be attached to a non-cylindrical substrate in some embodiments and a cylindrical substrate in other embodiments, depending on, for example, the size and shape of the ultra-hard material body, the formation being cut, the cutting tool on which the cutting element is disposed, and the method of attaching the cutting element to a cutting tool. For example, the ultra-hard material body 710 shown in FIGS. 24-27 is attached to a cylindrical substrate 724, where the outer side surface of the substrate 724 aligns with the side surface 712 of the ultra-hard material body 710, such that the cross-sectional shape of the substrate along a plane transverse to the longitudinal axis 730 has substantially the same size and shape as a cross-sectional shape of the ultra-hard material body 710 along a plane transverse to the longitudinal axis 730 and adjacent the substrate 724. However, in other embodiments, an ultra-hard material body such as the one shown in FIGS. 24-27 may be attached to a non-cylindrical substrate. Attaching the ultra-hard material body to a non-cylindrical substrate may provide, for example, different benefits in attaching the substrate to a cutting tool and/or attaching the ultra-hard material body to the substrate.

According to some embodiments of the present disclosure, a cutting element may include a substrate and an ultra-hard material body disposed on the substrate, where the ultra-hard material body has a side surface extending around a non-planar cutting face defined by two intersecting sloping surfaces forming a linear peak. The linear peak may extend the entire width of the non-planar cutting face, or may extend across the cutting face but less than the width of the cutting face, from a first portion of the side surface to a second portion of the side surface. The axial height of the ultra-hard material body along the linear peak may vary or may be substantially constant across its length. For example, in some embodiments, the axial height along a linear peak may continuously decrease across the length of the linear peak. Further, in some embodiments, the substrate may be cylindrical, while in other embodiments, the substrate may be non-cylindrical.

Figure 29:
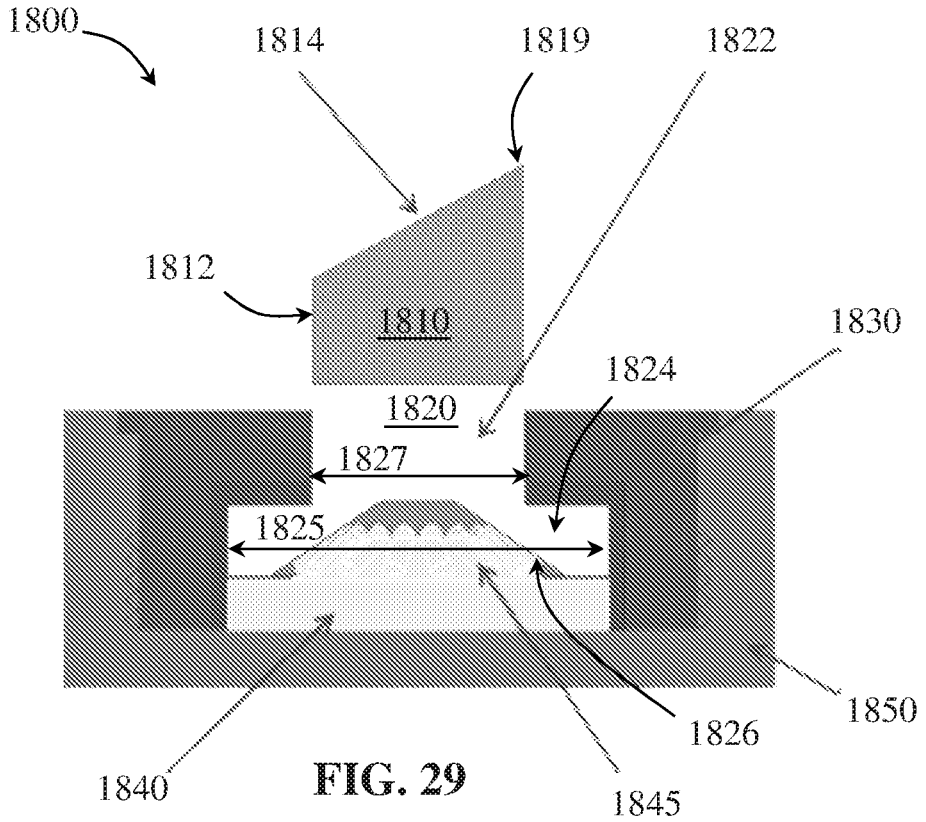
FIG. 29 shows a cross-sectional view of a cutting element assembly according to embodiments of the present disclosure.
Figure 30:
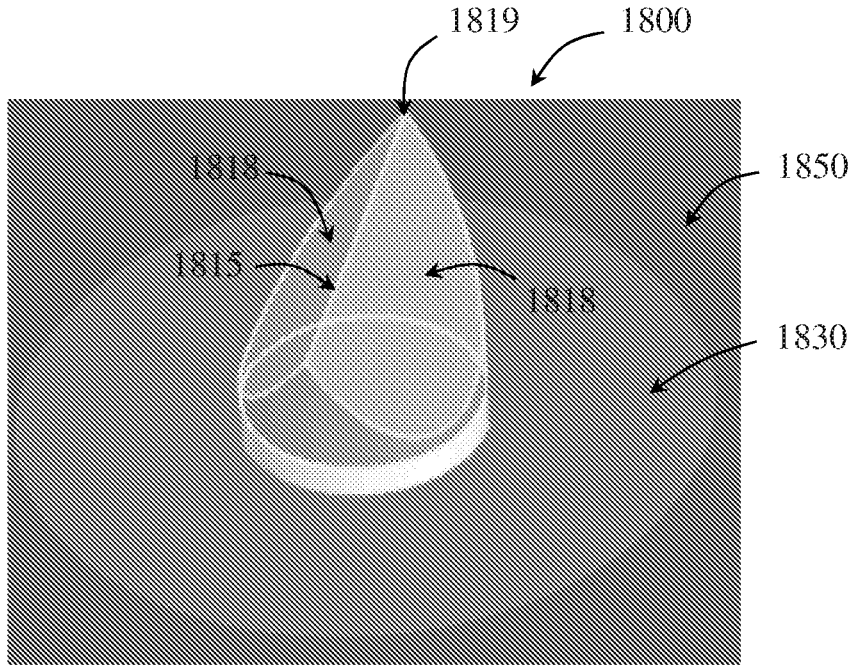
FIG. 30 shows a perspective view of a cutting element assembly according to embodiments of the present disclosure.

Referring now to FIGS. 29 and 30, a cross-sectional view and a perspective view, respectively, of a cutting element 1800 retained to a cutting tool 1850 according to embodiments of the present disclosure is shown. Cutting element 1800 has an ultra-hard material body 1810 attached to a non-cylindrical substrate 1820 at a planar interface, where the ultra-hard material body 1810 has a side surface 1812 extending around a non-planar cutting face 1814. Non-planar cutting face 1814 has two sloping surfaces 1818 intersecting at a linear peak 1815, where the linear peak 1815 extends across the cutting face 1814 and slopes downwardly from a cutting tip 1819, such that the axial height of the ultra-hard material body 1810 continuously decreases along the linear peak 1815, across the width of the non-planar cutting face 1814 from the cutting tip 1819 to the side surface 1812.

The non-cylindrical substrate 1820 has a cylindrical portion 1822, where the cross-sectional shape of the substrate 1820 along the cylindrical portion 1822 is circular, and a base portion 1824, where the outer diameter 1825 of the base portion 1824 is greater than the outer diameter 1827 of the cylindrical portion 1822, thereby forming a stepped profile. A retainer 1830 is disposed around at least the base portion 1824 of the substrate 1820, where the retainer 1830 has a first inner diameter less than a second inner diameter. The first inner diameter of the retainer 1830 is less than the outer diameter 1825 of the base portion 1824, such that the base portion 1824 is retained within the retainer 1830. The retainer 1830 is attached to the cutting tool 1850, thereby retaining the cutting element 1800 to the cutting tool 1850. A bearing base 1840 is disposed between the cutting tool 1850 and the cutting element 1800, and at least one bearing mechanism 1845 is disposed between the bearing base 1840 and a base surface 1826 of the base portion 1824. The bearing base 1840 may be integral with the cutting tool or may be a separate piece connected to the cutting tool. Bearing mechanisms may include, for example, ball bearings, roller bearings, or other bearing mechanisms that are capable of holding thrust load as well as radial load. In some embodiments, a bearing base may be coated with a low friction material, where the base surface of a cutting element may interface with and rotate upon the coating.

The cutting element 1800 may be mounted to and retained by the retainer 1830 to a cutting tool 1850. The cutting tool may have a tool body with a central axis extending there through and a plurality of blades extending outwardly from the tool body and converging towards a central region around the central axis, where the cutting element 1800 is mounted on the tool body between the plurality of blades in the central region. As shown in FIG. 29, the retainer 1830 may retain the assembled cutting element 1800 and bearing mechanism 1845 to the cutting tool 1850 by threading or screwing the retainer within a receiving cavity formed in the cutting tool 1850, where the base portion 1824 is free to rotate within the retainer 1830. Particularly, as the cutting tool rotates and cuts a formation, a core formation may form between the plurality of blades, in the central region of the cutting tool. As the core grows, it may contact and exert vertical force on the non-planar cutting face 1814 of the cutting element, thereby transferring a thrust load to the bearing base 1840, which may prevent the cutting element 1800 from rotating with respect to the formation. Thus, by providing the floating base portion within the retainer 1830 and bearing assembly, the cutting element 1800 may remain stationary while the cutting tool 1850 continues to rotate. The wedge shape formed in the non-planar cutting face 1814 of the cutting element 1800 may initiate cracks in the core, and the sloping surfaces 1818 may force the cracked formation to go off center and removed from the cutting area.

Figure 31:
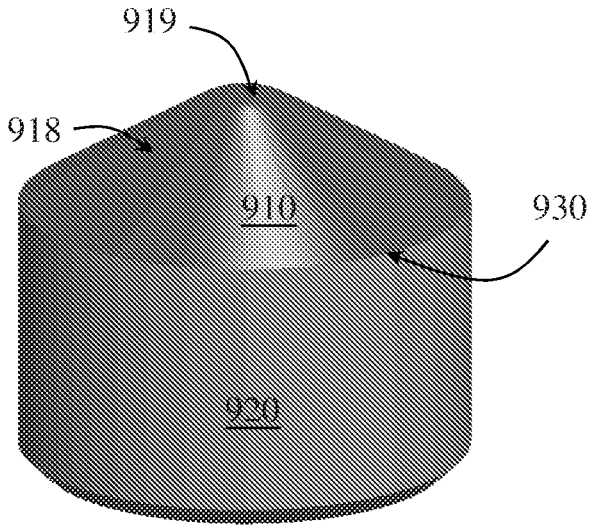
FIG. 31 shows a perspective view of a cutting element according to embodiments of the present disclosure.
Figure 32:
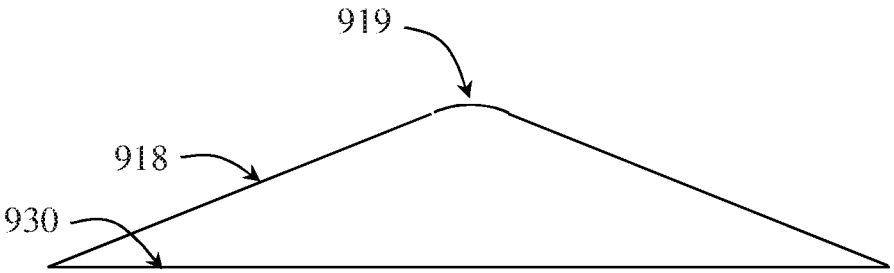
FIG. 32 shows a cross-sectional view of an ultra-hard material body according to embodiments of the present disclosure.
Figure 33:
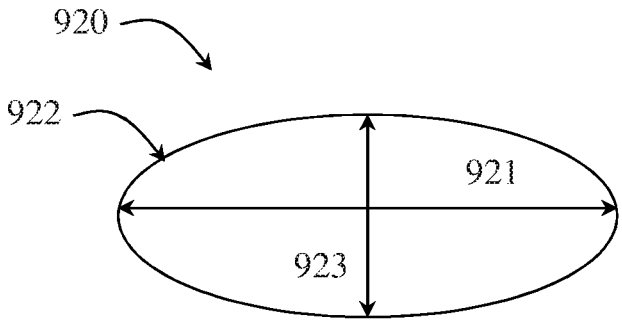
FIG. 33 shows a cross-sectional view of non-cylindrical substrate according to embodiments of the present disclosure.

Referring now to FIGS. 31-33, a cutting element 900 having a non-planar cutting face 914 according to embodiments of the present disclosure is shown, where the cutting element 900 includes an ultra-hard material body 910 disposed on a non-cylindrical substrate 920 at an interface 930 and a longitudinal axis extending axially there through. Particularly, FIG. 31 shows a perspective view of the cutting element 900, FIG. 32 shows a cross-sectional view of the ultra-hard material body 910 along its longitudinal axis, and FIG. 33 shows a cross-sectional view of the substrate 920 along a plane transverse to the longitudinal axis. The ultra-hard material body 910 has an elliptical base shape at its interface 930 surface and a sloping surface 918 extending from the interface 930 to an apex forming a cutting tip 919. However, in other embodiments, an ultra-hard material body 910 may include a side surface extending from the interface, where the non-planar cutting face extends from and intersects with the ultra-hard material body side surface, and where the ultra-hard material body side surface may align with the substrate or may form a cross-sectional shape different than the substrate. The cutting tip 919 may be curved with a radius of curvature, angled, or may include a cropped or planar surface. For example, according to embodiments of the present disclosure, a cutting tip 919 may have a radius of curvature ranging from about 0.05 to 0.12 inch. Further, the ultra-hard material body 910 may have a height measured between the cutting tip 919 and the base of the ultra-hard material body, or interface with substrate 920, where the height may range from about 0.1 inch to about 0.625 inch.

The substrate 920 has an outer side surface 922 that defines an elliptical cross-sectional shape along a plane transverse to the longitudinal axis. The ultra-hard material body 910 has a cross-sectional shape at its interface 930 corresponding with the cross-sectional shape of the substrate 920, such that the shape and size of the ultra-hard material body 910 at its interface 930 aligns with the interfacing surface of the substrate 920. However, in other embodiments, an ultra-hard material body and substrate may have different cross-sectional shapes at their interface. For example, in some embodiments, a substrate may have an elliptical cross-sectional shape along a plane transverse to the longitudinal axis and at the interface, and the ultra-hard material body may have a non-elliptical cross-sectional shape along a plane transverse to the longitudinal axis and at the interface. In other embodiments, an ultra-hard material body may have an elliptical cross-sectional shape along a plane transverse to the longitudinal axis and at the interface, and the substrate may have a non-elliptical cross-sectional shape along a plane transverse to the longitudinal axis and at the interface.

As shown in FIG. 33, the cross-sectional shape of the substrate 920, and thus the elliptical base shape of the ultra-hard material body 910, may have a major axis 921 and a minor axis 923 perpendicular to the major axis 921, where the major axis 921 dimension is greater than the minor axis 923 dimension. For example, according to embodiments of the present disclosure, the minor axis dimension may be about 45 to 95 percent of the major axis dimension.

Although just a few embodiments have been described in detail above, those skilled in the art will appreciate that many modifications are possible in the example embodiments without materially departing from the apparatus, systems, and methods disclosed herein. Accordingly, such modifications are intended to be included within the scope of this disclosure. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function. Each addition, deletion, and modification to the embodiments that fall within the meaning and scope of the claims is to be embraced by the claims.

What is claimed:

1. A cutting tool, comprising:

a body having a central axis extending therethrough;

a plurality of blades extending outwardly from the body and converging towards a central region around the central axis; and at least one cutting element, comprising:

a longitudinal axis;

a non-cylindrical substrate; and an ultra-hard material body on the non-cylindrical substrate, the ultra-hard material body comprising:

a side surface extending around a cutting face and defining a cross-sectional shape of the ultra-hard material body, the side surface comprising an edge having an inner angle of less than 180 degrees, wherein the cross-sectional shape of the ultra-hard material body is a tear-drop shape having a length between the edge and an opposite portion of the side surface and a width that extends across the longitudinal axis transverse to the length, wherein the length is between 20 to 50 percent greater than the width.

2. The cutting tool of claim 1, wherein the cutting face is non-planar.

3. The cutting tool of claim 2, wherein the cutting face is defined by at least two intersecting surfaces forming a linear peak extending along the length-of the cutting face.

4. The cutting tool of claim 3, wherein an axial height of the ultra-hard material body at the edge of the side surface is greater than the axial height of the ultra-hard material body at the opposite portion of the side surface.

5. The cutting tool of claim 1, wherein the cross-sectional shape of the ultra-hard material body substantially aligns with a non-circular cross-sectional shape of the non-cylindrical substrate defined along a plane transverse to the longitudinal axis.

6. The cutting tool of claim 1, wherein the cross-sectional shape of the ultra-hard material body is different from a cross-sectional shape of the non-cylindrical substrate defined along a plane transverse to the longitudinal axis.

7. The cutting tool of claim 1, wherein the non-cylindrical substrate comprises a first cross-sectional shape along a first plane transverse to the longitudinal axis and a second cross-sectional shape along a second plane transverse to the longitudinal axis, wherein the first cross-sectional shape is different than the second cross-sectional shape.

8. The cutting tool of claim 1, wherein the cross-sectional shape of the ultra-hard material body varies along the longitudinal axis.

9. The cutting tool of claim 1, wherein the at least one cutting element is on at least one of the plurality of blades or is on the body between the plurality of blades and in the central region.

10. The cutting tool of claim 1, wherein the at least one cutting element is on the body between the plurality of blades in the central region.

11. A cutting element, comprising:

a longitudinal axis;

a substrate; and an ultra-hard material body disposed on the substrate, the ultra-hard material body comprising:

a non-planar outer surface having a plurality of linear peaks and a plurality of valleys alternating there between, the plurality of linear peaks converging at an apex, wherein the alternating plurality of linear peaks and the plurality of valleys form a plurality of lobes.

12. The cutting element of claim 11, where at least one of the plurality of valleys maintains a concave shape along its height.

13. The cutting element of claim 11, where at least one of the plurality of lobes extends in a radially outward direction at an angle offset from the longitudinal axis.

14. A downhole cutting tool, comprising:

a body having a central axis extending therethrough;

a plurality of blades extending outwardly from the body and converging towards a central region around the central axis; and at least one cutting element configured to rotate relative to the downhole cutting tool, the at least one cutting element comprising:

a substrate; and an ultra-hard material body on the substrate, the ultra-hard material body comprising:

a non-planar cutting face comprising two intersecting surfaces forming a linear peak, the linear peak extending a width of the non-planar cutting face; and wherein an axial height of the ultra-hard material body along the linear peak varies.

15. The cutting tool of claim 14, wherein the axial height continuously decreases across the width of the non-planar cutting face.

16. The cutting tool of claim 14, wherein the substrate is non-cylindrical.

17. The cutting tool of claim 14, further comprising:

a retainer disposed around at least a base portion of the substrate, the retainer comprising a first inner diameter less than a second inner diameter, and the base portion comprising a base surface and an outer diameter greater than the first inner diameter of the retainer;

a bearing base; and at least one bearing mechanism disposed between the bearing base and the base surface of the substrate, wherein the at least one bearing mechanism is configured to facilitate rotation of the at least one cutting element relative to the bearing base and the downhole cutting tool.

18. The cutting tool of claim 14, wherein the at least one cutting element is on the tool body between the plurality of blades in the central region.

19. The cutting tool of claim 14, wherein the substrate is cylindrical.

* * * * *